United States Patent [19]

Burgis

[11] Patent Number: 4,953,109

[45] Date of Patent: Aug. 28, 1990

[54] AUTOMATED TRASH COMPACTOR SYSTEM

[75] Inventor: Stephen A. Burgis, Birmingham, Mich.

[73] Assignee: Design-Rite, Inc., Sterling Heights, Mich.

[21] Appl. No.: 421,923

[22] Filed: Oct. 16, 1989

[51] Int. Cl.[5] ..... B30B 15/50

[52] U.S. Cl. ..... 364/550; 100/49; 100/50; 100/99; 60/431; 60/432; 414/517; 53/529

[58] Field of Search ..... 364/550, 551.01, 505, 364/506; 100/49, 50, 99, 229 A; 414/517; 53/529; 73/379; 116/204; 340/686; 60/376, 431, 432, 911; 91/35, 356; 318/3, 445, 455, 484, 488, 565, 566, 635, 646, 650

[56] References Cited

U.S. PATENT DOCUMENTS

| | | | |
|---|---|---|---|
| 2,251,490 | 8/1941 | Kucher | 230/55 |
| 3,465,276 | 9/1969 | Silva et al. | 328/142 |
| 3,802,335 | 4/1974 | Longo | 100/50 |
| 3,855,515 | 12/1974 | Hutchins, Jr. | 318/685 |
| 3,859,565 | 1/1975 | Henningsen | 317/13 R |
| 4,212,071 | 7/1980 | Dortu | 364/505 |
| 4,248,258 | 2/1981 | Devitt et al. | 137/124 |
| 4,274,282 | 6/1981 | Bundraitis | 100/99 X |
| 4,410,927 | 10/1983 | Hewitt et al. | 361/25 |
| 4,446,787 | 5/1984 | Nishikawa et al. | 100/99 |
| 4,643,087 | 2/1987 | Fenner et al. | 100/99 X |
| 4,729,304 | 3/1988 | Gardella et al. | 100/50 |
| 4,773,027 | 9/1988 | Neumann | 364/550 |
| 4,781,111 | 11/1988 | Chesnut | 100/99 |

FOREIGN PATENT DOCUMENTS

| | | | |
|---|---|---|---|
| 0125879 | 9/1979 | Japan | 100/229 A |
| 2087791 | 6/1982 | United Kingdom | 100/229 A |

*Primary Examiner*—Kevin J. Teska
*Assistant Examiner*—Joseph L. Dixon
*Attorney, Agent, or Firm*—Remy J. VanOphem

[57] ABSTRACT

An automated trash compaction system having an hydraulic cylinder displacing a ram to compact trash in a mobile trash container and having an electronic control unit controlling the displacement of the ram. The electronic control unit generates a ram forward signal in response to a start signal, generates a part-full signal in response to electrical current being supplied to an electric motor driving a fluid pump exceeding a part-full value, and generates a full signal in response to the current being supplied to the electric motor exceeding a full value. After a predetermined full stroke time or upon the generation of the full signal, the electronic control unit terminates the ram forward signal and generates a ram return signal returning the ram to a retracted position. The ram return signal is terminated when the current to the electric motor exceeds a predetermined value. The electronic control also has calibration subroutines for automatically generating the predetermined full stoke time, the part-full value and the full value.

48 Claims, 13 Drawing Sheets

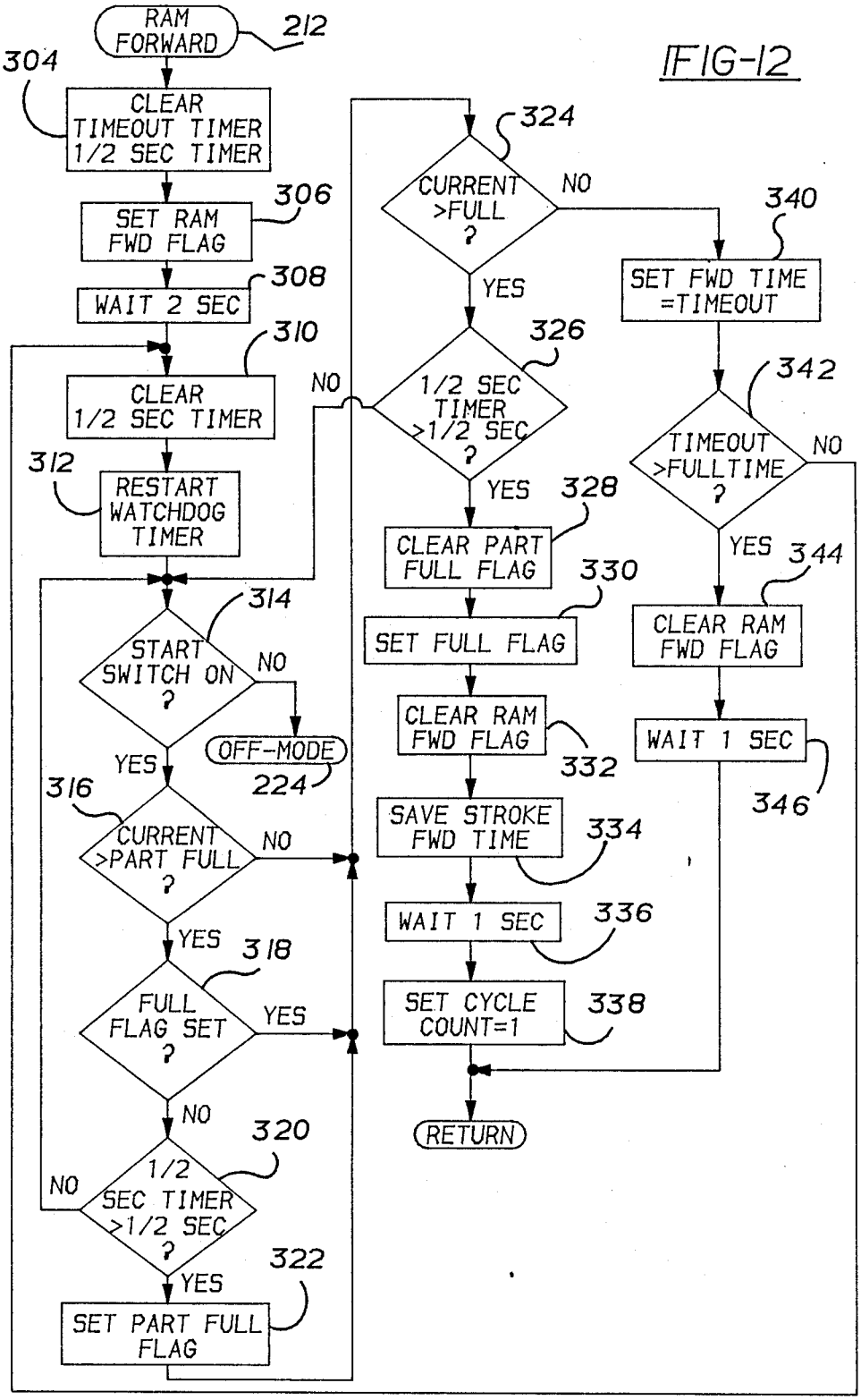
FIG-12
RAM FORWARD
212
304
CLEAR TIMEOUT TIMER 1/2 SEC TIMER
306
SET RAM FWD FLAG
308
WAIT 2 SEC
310
CLEAR 1/2 SEC TIMER
312
RESTART WATCHDOG TIMER
314
START SWITCH ON ?
NO
OFF-MODE
224
YES
316
CURRENT >PART FULL ?
NO
YES
318
FULL FLAG SET ?
YES
NO
320
1/2 SEC TIMER >1/2 SEC ?
NO
YES
322
SET PART FULL FLAG
324
CURRENT >FULL ?
NO
YES
326
1/2 SEC TIMER >1/2 SEC ?
NO
YES
328
CLEAR PART FULL FLAG
330
SET FULL FLAG
CLEAR RAM FWD FLAG
332
SAVE STROKE FWD TIME
334
WAIT 1 SEC
336
SET CYCLE COUNT=1
338
RETURN
340
SET FWD TIME =TIMEOUT
342
TIMEOUT >FULLTIME ?
NO
YES
344
CLEAR RAM FWD FLAG
WAIT 1 SEC
346

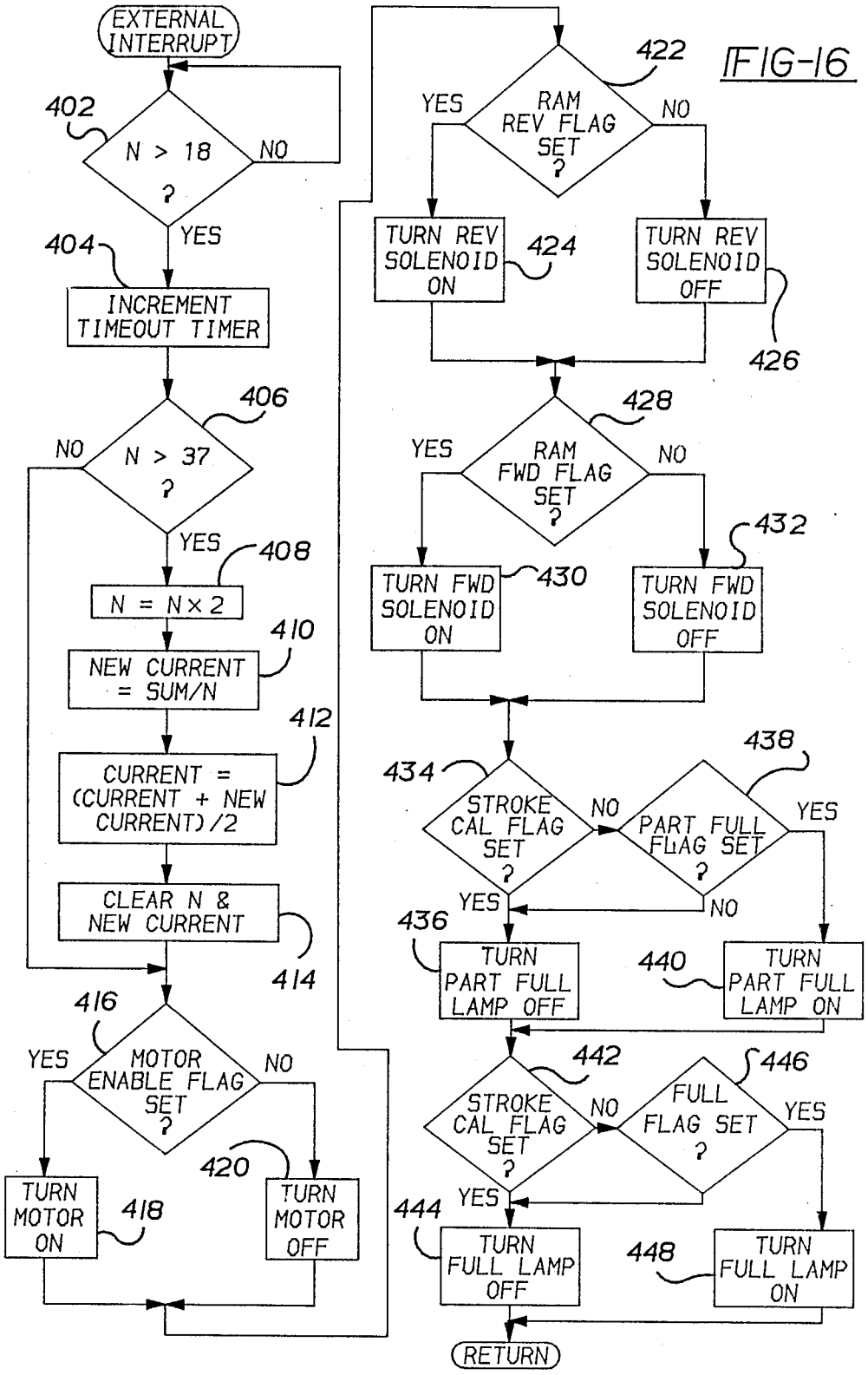
FIG-16
EXTERNAL INTERRUPT
402
N > 18 ?
NO
YES
404
INCREMENT TIMEOUT TIMER
406
N > 37 ?
NO
YES
408
N = N×2
410
NEW CURRENT = SUM/N
412
CURRENT = (CURRENT + NEW CURRENT)/2
CLEAR N & NEW CURRENT
414
416
MOTOR ENABLE FLAG SET ?
YES
NO
TURN MOTOR ON
418
420
TURN MOTOR OFF
422
RAM REV FLAG SET ?
YES
NO
TURN REV SOLENOID ON
424
TURN REV SOLENOID OFF
426
428
RAM FWD FLAG SET ?
YES
NO
TURN FWD SOLENOID ON
430
432
TURN FWD SOLENOID OFF
434
STROKE CAL FLAG SET ?
NO
438
PART FULL FLAG SET ?
YES
YES
NO
436
TURN PART FULL LAMP OFF
440
TURN PART FULL LAMP ON
442
STROKE CAL FLAG SET ?
NO
446
FULL FLAG SET ?
YES
YES
444
TURN FULL LAMP OFF
448
TURN FULL LAMP ON
RETURN

AUTOMATED TRASH COMPACTOR SYSTEM

BACKGROUND OF THE INVENTION

1. Field of the Invention

The invention is related to the field of trash compactors and in particular to a system for automatically controlling the operation of a trash compactor.

2. Description of the Prior Art

The ever increasing volume of trash being generated has created the need for an effective and efficient method of disposal. To this end, mobile trash containers have proven to be very effective for the removal of trash from factories, large buildings, apartment complexes, and other such facilities. These mobile trash containers are placed in or near the factories or other facilities where they are filled by the local users. The full trash containers are then periodically emptied or exchanged for an empty one by a hauler who transports the trash to a landfill, incinerator, or other designated disposal location. This method of trash disposal has been optimized over a period of years by the use of trash compactors which compress the trash in the trash containers so that it can effectively hold more trash. This factor substantially increases the time interval before the trash container must be emptied. Since the major expense in the disposal of this trash is the cost of hauling the trash to the disposal site, it is obvious that the use of the trash compactors reduces the frequency at which the trash container must be emptied thereby optimizing the process.

The proces can be further optimized if the hauling of part-full trash containers can be minimized. Neumann, U.S. Pat. No. 4,773,027, discloses an automated trash management system in which the compactor system is capable of measuring the fullness of each trash compactor by monitoring the fluid pressure applied to an hydraulic compactor. The fullness of the trash container is calculated from the monotonically increasing portion of the monitored pressure. The trash management system also includes a data transmission link between each trash compactor and a central location so that the hauler is constantly aware of the fullness of each trash container. The emptying or removal of the full trash containers can then be scheduled, significantly improving the efficiency of the trash management system.

SUMMARY OF THE INVENTION

The invention is an automated trash compactor system for compacting trash in a mobile trash container. The trash compactor system has a compactor having a movable ram, a hydraulic cylinder for displacing the ram in a forward direction to compact the trash in the mobile trash container and for displacing the ram in a reverse direction, a fluid pump for providing a pressurized fluid to the hydraulic cylinder, and a solenoid valve disposed between the fluid pump and the hydraulic cylinder. The solenoid valve has at least a first state in response to a ram forward signal connecting the fluid pump to the hydrualic cylinder so that the hydraulic cylinder displaces the ram in a forward direction compacting the trash in the mobile trash container and at least a second state in response to a ram reverse signal connecting the fluid pump to the hydraulic cylinder so that the hydraulic cylinder displaces the ram in a reverse direction away from the mobile trash container. The trash compactor system further has an electric motor driving the fluid pump, a current sensor for generating a current signal having a value corresponding to the electrical current being used by the motor, means for generating a start signal and an electronic control responsive to the start and current signals. The electronic control has a ram forward control means for generating a ram forward signal for a predetermined period of time in response to the start signal, part-full signal generating means for generating a part-full signal indicating that the trash container is approximately 80% full in response to the ram forward signal and the current signal having a value exceeding a predetermined part-full vaule, a full signal generating means for generating a full signal indicating that the trash container is full in response to the ram forward signal and the current signal exceeding a full value.

The electronic control may also have means responsive to the start signal and the current signal for generating the predetermined period of time, the predetermined part-full value and the predetermined full value.

In the preferred embodiment, the electronic control is embodied by a programmed microprocessor having adequate storage and computation means.

The object of the invention is an automated trash compactor system having a single sensor responsive to the electric current being supplied to the electric motor driving the hydraulic pump.

Another object of the automated trash compactor system is a control system which is self-calibrating each time it is turned on.

Another object of the trash compactor system is to generate signals indicating when the trash container is part-full (eighty percent full) and when the trash container is full.

Still another object of the trash compactor system is an electronic control system embodied by a microprocessor system having adequate storage and computational means.

Yet another object of the invention is a trash compactor system having both an automatic mode of operation and a manual mode of operation.

These and other objects of the automated trash compactor system will become more apparent from a reading of the detailed description of the invention in conjunction with the drawings.

BRIEF DESCRIPTION OF THE DRAWINGS

FIG. 12 is a flow diagram of the Ram Forward subroutine;

FIG. 16 is a flow diagram of the External Interrupt subroutine;

DETAILED DESCRIPTION OF THE PREFERRED EMBODIMENT

Figure 1:
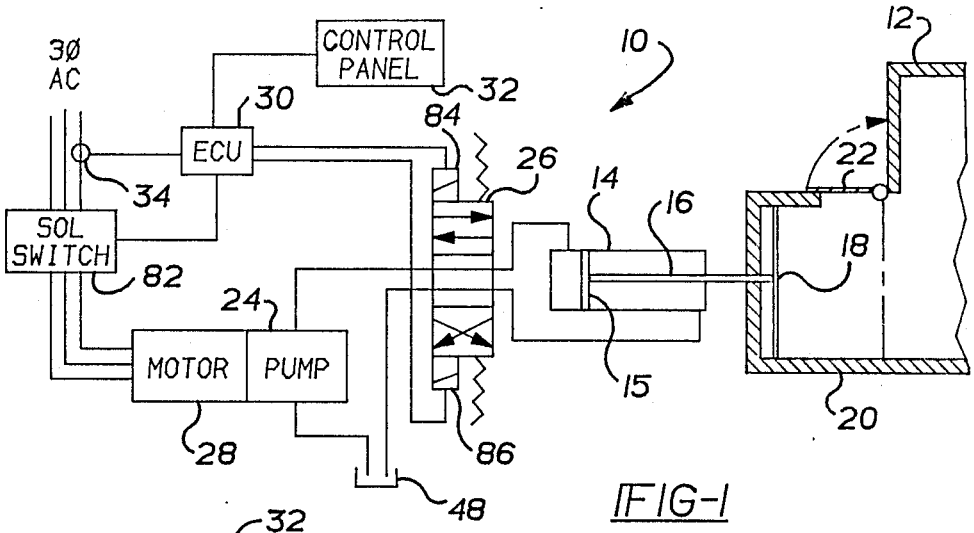
FIG. 1 is a block diagram of the automated trash compactor system.

FIG. 1 is a block diagram of the automated trash compaction system. A trash compactor 10 is connected to one end of a mobile trash container 12 in a conventional manner as shown in U.S. Pat. No. 4,773,027. The trash compactor 10 has an hydraulic cylinder 14 having a piston 15 connected to a push rod 16 extending from one end thereof. The push rod 16 is connected to a ram 18 contained in a ram housing 20 connected to the mobile trash container 12. An opening, such as a door 22, is provided in the ram housing 20 to permit trash to be deposited in the ram housing. Alternatively, the opening may be a trash chute as shown in U.S. Pat. No. 4,773,027.

The hydraulic cylinder 14 is actuated by the pressure from a fluid pump 24 through a three-way solenoid valve 26. The fluid pump 24 is driven by an electric motor 28. Depending upon the power requirements of the trash compactor, the electric motor 28 may be a single phase or a three phase 208–575 volt AC motor as shown.

Energization of the three-way solenoid valve 26 is controlled by an electrical control unit (ECU) 30 in response to switch settings on a control panel 32 and the electrical power being applied to the electric motor 28. A current sensor 34, such as series CS 60 current sensor manufactured by Coilcraft of Cary, Ill., circumscribes one of the electrical leads to the electric motor 28 and generates a signal indicative of the current being consumed by the motor.

Figure 2:
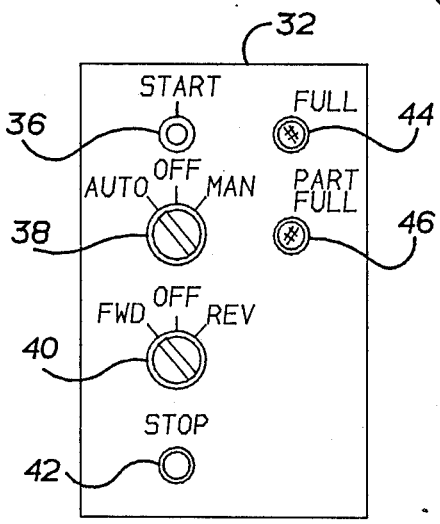
FIG. 2 is a front view of the control panel.

The control panel 32, as shown in FIG. 2, has a push button START switch 36, a key actuated three-position MODE switch 38, a three position RAM DIRECTION switch 40 and a STOP switch 42. The control panel 32 also has a FULL indicator lamp 44 which is lit when the trash container 12 is full and a PART-FULL indicator lamp 46 which is lit when the trash container 12 is approximately 80% full. The MODE switch 38 is key actuated to prevent unauthorized operation of the trash management system. The MODE switch permits the operator to choose between an automatic (AUTO) mode of operation or a manual (MAN) mode of operation. In the automatic mode of operation, the system is controlled by the electronic control unit 30 while in the manual mode the operation of the hydraulic cylinder 14 and the ram 18 is also controlled by the electronic control unit in response to the operator actuating the RAM DIRECTION switch 40. The RAM DIRECTION switch 40 is spring biased to an OFF position and may be rotated to a RAM FORWARD (FWD) position or a RAM REVERSE (REV) position which causes the ram 18 to move in a forward or reverse direction, respectively. The STOP switch 42 is an emergency stop in the event of a mechanical or electrical problem detected by the operator.

Referring back to FIG. 1, the three-way solenoid valve 26 has a spring loaded neutral position in which the output of the fluid pump 24 is circulated back to a fluid reservior 48 which also is the fluid source for the fluid pump 24. When actuated in a first direction, the solenoid valve connects the output of the fluid pump to a forward inlet port of the hydraulic cylinder 14 which causes the ram 18 to be moved in a forward direction and push the trash into the trash container 12. When actuated in the reverse direction, the solenoid valve 26 connects the output of the fluid pump 24 to a ram return inlet port at the other end of the hydraulic cylinder 14 which causes the ram 18 to be moved in a reverse direction away from the trash container 12. As previously indicated, energizing of the three-way solenoid valve 26 to move the trash into the trash container 12 and to return the ram 18 to its withdrawn position is controlled by the electronic control unit 30 when the system is in the automatic mode of operation or by the RAM DIRECTION switch 40 when the system is in the manual mode of operation.

Figure 3:
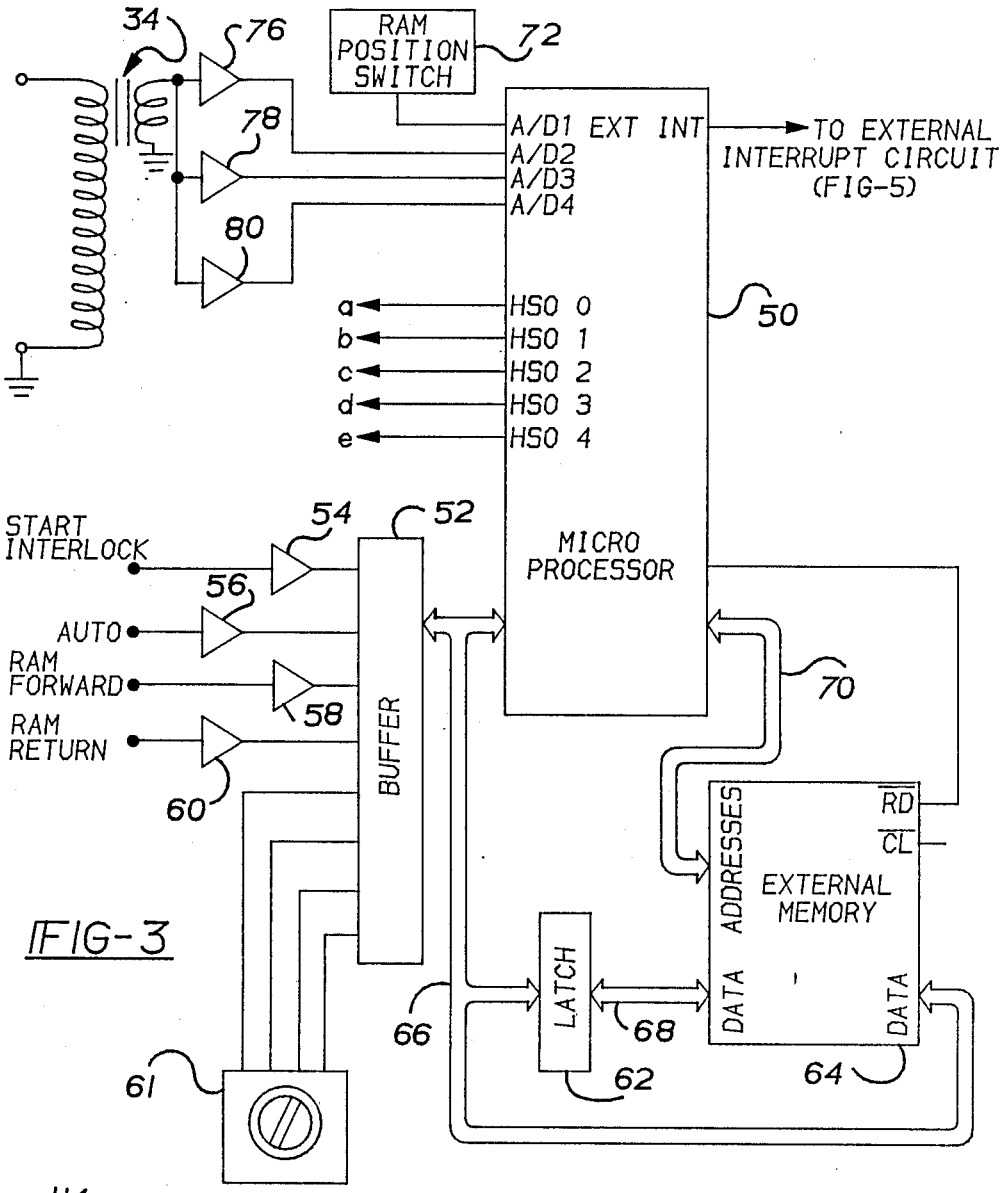
FIG. 3 is a block diagram of the electronic control unit.

The details of the electronic control unit 30 are shown in FIG. 3. The electronic control unit 30 has a microprocessor 50, such as Intel 8098, which is connected by means of a buffer 52, such a 75H0244H manufactured by National Semiconductor, and optical isolators 54, 56, 58 and 60 to the START switch 36, the MODE switch 38 and the RAM DIRECTION switch 40 on the control panel 32. The optical isolator 54 receives a signal indicative of the START switch 36 being in the "start" position, the optical isolator 56 receives a signal indicative of the MODE switch 38 being in the "automatic" (AUTO) position, the optical isolator 58 receives a signal indicative of the RAM DIRECTION switch 40 being in the "forward" position and the optical isolator 60 receives a signal of the RAM DIRECTION switch 40 being in the "reverse" position.

The outut of a cycle switch 61 is also connected to the buffer 52. The cycle switch 61 generates a signal on an appropriate lead indicative of the number of times the ram 18 will be moved forward and back during each cycle in the automatic mode of operation.

The data from the buffer 52 is transferred as required to the microprocessor 50, a latch 62 and an external memory 64, such as EPROM TD2732A-20 manufactured by Intel, by a bus 66. A bus 68 provides for direct data transfer between the latch 62 and the external memory 64 while an address bus 70 transfers the addresses generated by the microprocessor 50 to the external memory for the storage and retrieval of data. The external memory 64 also stores the operational program of the microprocessor 50 such as shall be described in detail hereinafter.

A ram position switch 72 determines the final position of the ram 18 at the end of the automatic mode of operation. The ram position switch 72 has a first position which generates a signal signifying the ram 18 should be left in the retracted position at the end of the operational cycle, a second position generating a second signal signifying the ram should be left in its forward position at the end of the operation cycle, and a third position used in a self-test routine at the point of manufacture. This self-test routine is only used for manufacturing purposes and is not used in the every day operation of the automated trash compaction system.

The current sensor 34 has a primary winding responsive to the current flowing in one of the leads to the motor 28. The current sensor 34 also has a secondary winding which is connected in parrallel to amplifiers 76, 78, and 80, respectively. The gain of the amplifier 78 is higher than the gain of the amplifier 76 and the gain of the amplifier 80 is higher than the gain of the amplifier 78. In the calibration routine to be discussed later, the microprocessor will select the output of one of these three amplifiers 76, 78, or 80 as the one to be used as a signal indicative of the current being used by the electric motor 28. The outputs of the amplifiers 76, 78 and 80 are connected to separate analog to digital (A/D) input terminals of the microprocessor 50. As shall be explained relative to the A/D Calibration subroutine shown in FIG. 9, the microprocessor will select the output from one of the three amplifiers 76, 78, or 80 to use as a signal indicative of the electrical power being applied to the electric motor 28 to determine when the trash container is part-full (80% full) or full.

The outputs of the microprocessor, leads a through e, are applied to a motor solenoid switch 82, a RAM FORWARD solenoid 84 and a RAM REVERSE solenoid 86 of the three-way solenoid valve 26, the FULL indicator lamp 44 and the PART-FULL indicator lamp 46 shown in FIGS. 1 and 2.

Figure 4:
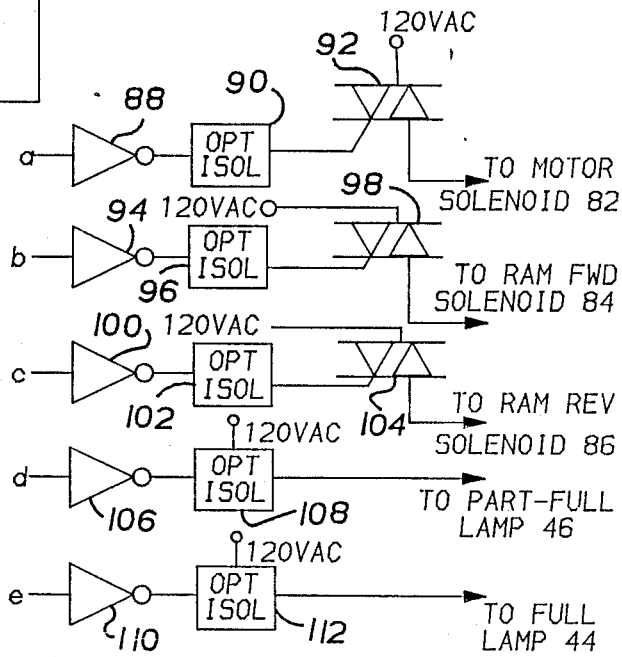
FIG. 4 is a circuit diagram of the electronic control unit output circuits.

Referring to FIG. 4, the output "a" of the microprocessor 50 is applied to the gate of a triac 92 through an inverter 88 and an optical isolator 90. The triac 92 is connected between a 120 V AC electrical source and the motor solenoid switch 82. In a like manner, the output "b" of the microprocessor is connected to the gate of a triac 98 through an inverter 94 and an optical isolator 96 and the output "c" is connected to the gate of a triac 104 through an inverter 100 and an optical isolator 102. The output of the triac 98 is connected to the RAM FORWARD solenoid 84 of the three-way solenoid valve 26 and the output of the triac 104 is connected to the RAM REVERSE solenoid 86. The output "d" of the microprocessor 50 actuates the PART-FULL lamp 46 on the control panel 32 through an inverter 106 and optical isolator 108 while the output "e" actuates the FULL lamp 44 on the control panel 32 through an inverter 110 and optical isolator 112.

Figure 5:
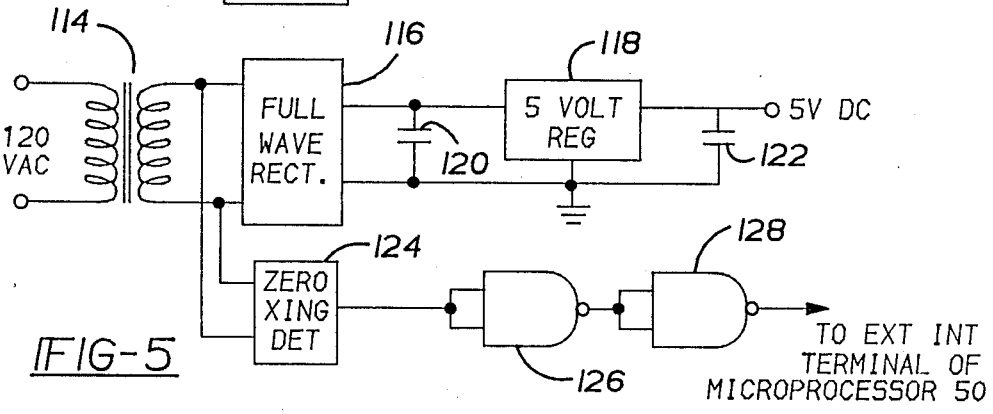
FIG. 5 is a circuit diagram of the 5V DC power supply and the circuit for generating the external interrupt signal.

FIG. 5 shows the details of the DC power supply for the electronic control unit 30 and the circuit for generating an external 60 hertz interrupt signal. A transformer 114 has its primary windings connected to a 120 V AC source of electrical power and its secondary windings connected to a full wave rectifier 116. The output of the full wave rectifier 116 is connected to a 5 volt regulator 118. Filter capacitors 120 and 122 are connected in parallel to either side of the 5 volt regulator 118 to remove any residual AC noise or other voltage variations that may occur. A zero crossing detector 124 is connected across the secondary winding of the transformer 114 in parallel with the full wave rectifier 116. The output of the zero crossing detector is connected to the external interrupt terminal of the microprocessor 50 through a pair of serially connected NAND gates 126 and 128. The microprocessor 50 internally generate a 1,200 hertz interrupt signal for purposes to be described hereinafter.

The operation of the automated trash management system shall be discussed in detail relative to the flow diagrams presented in FIGS. 6 through 16. These flow diagrams delineate the program executed by the microprocessor when the system is first turned on and when the system is in the automatic (AUTO) mode of operation.

Figure 6:
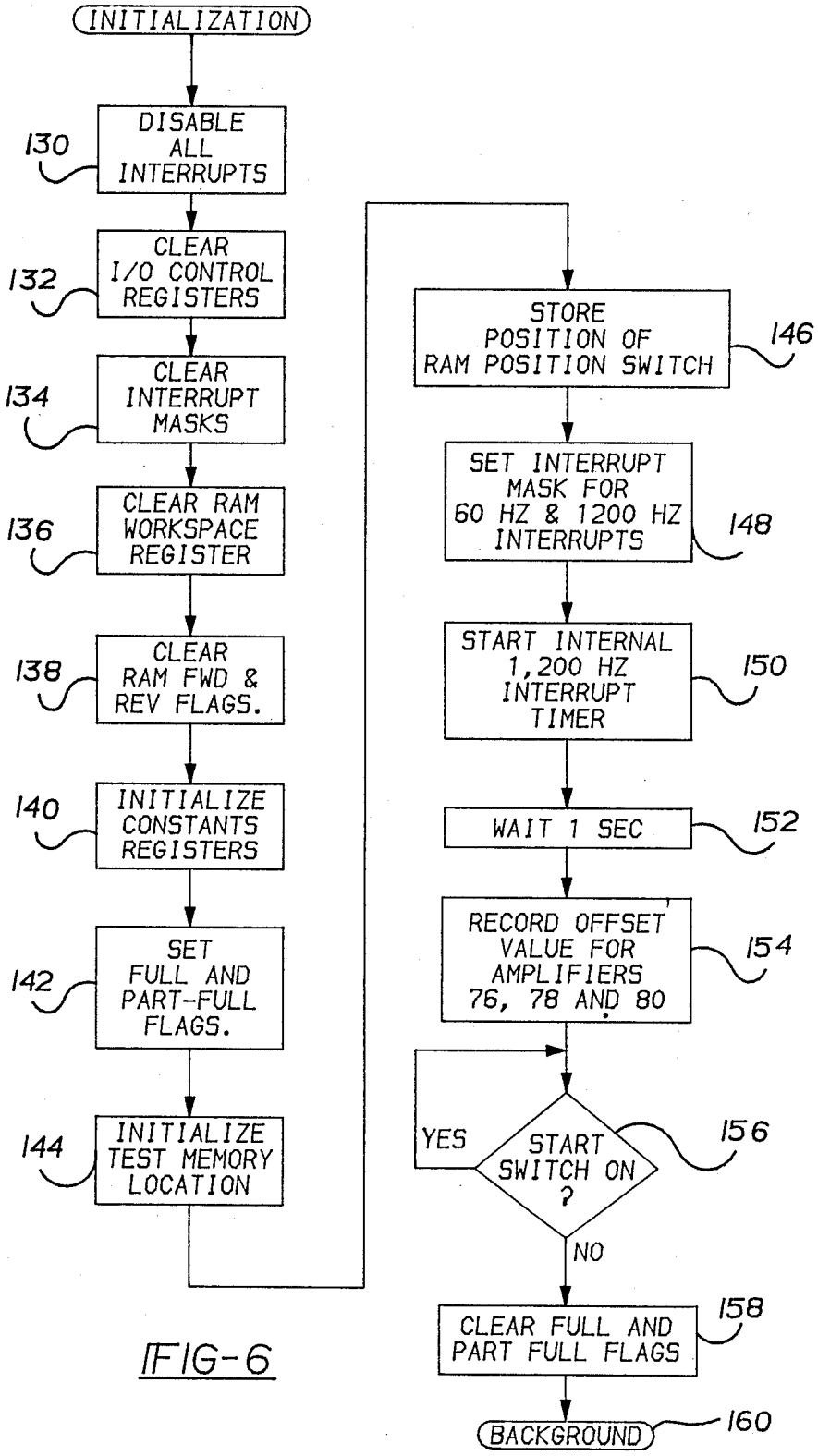
FIG. 6 is a flow diagram of the Initialization subroutine of the electronic control unit.
Figure 7:
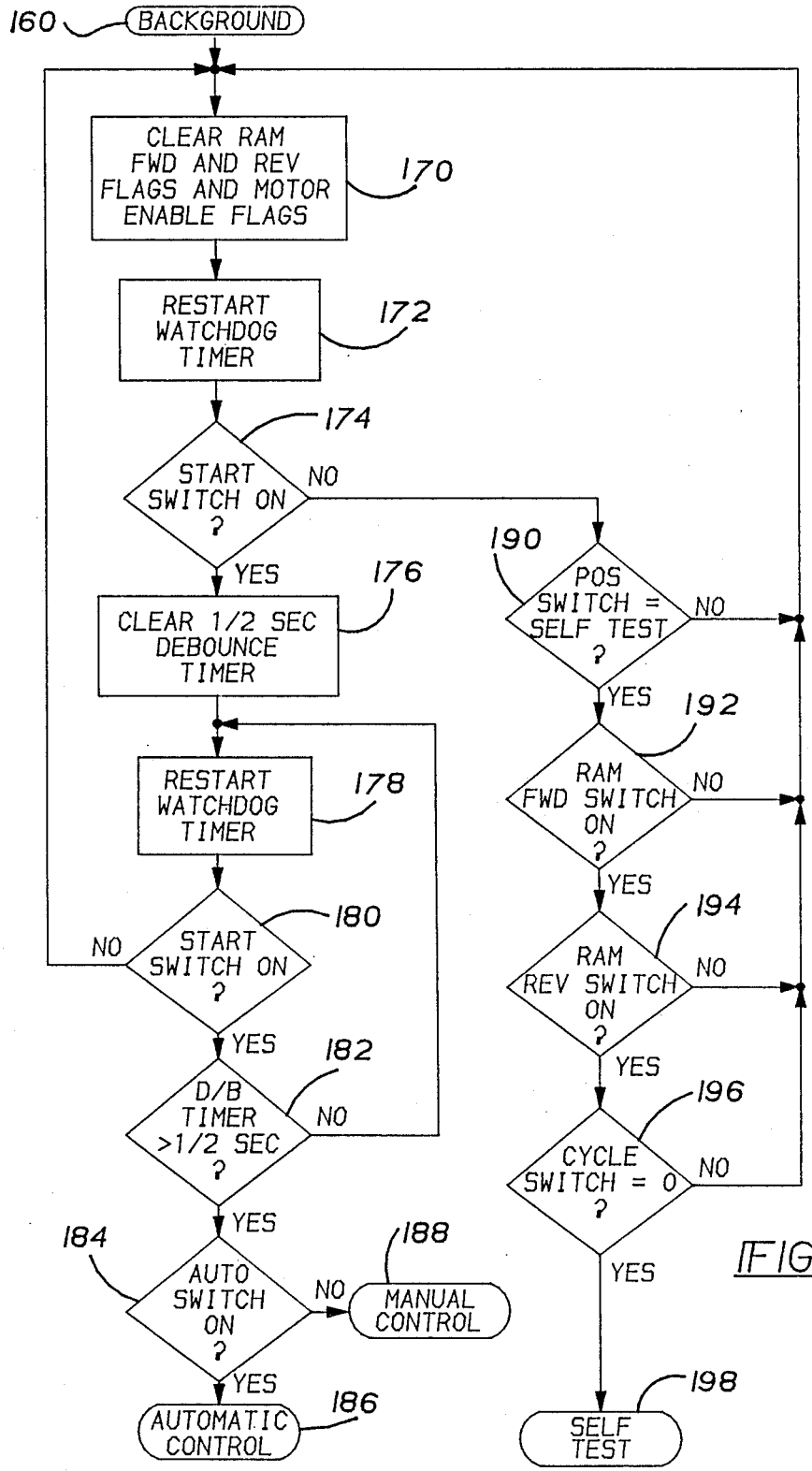
FIG. 7 is a flow diagram of the Background subroutine.

FIG. 6 shows the Initialization subroutine executed by the microprocessor 50 when the system is turned on. The Initialization subroutine begins by disabling all the interruptions as indicated in block 130 and then proceeds to clear the input/output control registers as indicated in block 132. After clearing the control registers, the subroutine will clear the interrupt mask as indicated in block 134 then clears the ram work space register, as shown in block 136. The RAM FORWARD and REVERSE flags are then cleared and initialized the constant registers as indicated by blocks 138 and 140, respectively. The Initialization subroutine will then set the FULL and PART-FULL flags as indicated by block 142. As shall be explained later, when the FULL and PART-FULL flags are set, the Interrupt subroutine will turn on the FULL and PART-FULL lamps on the control panel 32. After the FULL and PART-FULL flags are set the subroutine will initialize the test memory location as indicated by block 144 and store the position of the ram position switch as indicated by block 146. It will then proceed to set the interrupt mask for the 60 hertz and 1,200 hertz interrupts as indicated by block 148. The program will then start the internal 1,200 hertz interrupt timer as indicated by block 150, and wait for one second as indicated by block 152. The Intialization subroutine will then record the offset values for the amplifiers 76, 78, and 80 as indicated by block 154. These are amplifiers used to amplify the current signal generated by the current sensor 82 as shown in FIG. 3. The subroutine will then inquire if the START switch is on as indicated by decision block 156. If the START switch is on, the subroutine will wait until the START switch is turned off. After the START switch is turned off the subroutine will clear the FULL and PART-FULL flags, as indicated by block 158, then proceed to call up the Background subroutine as indicated in block 160.

The Background subroutine 160 is an idle routine which is executed by the microprocessor while waiting for the START switch to be turned on. The Background subroutine 160 begins by clearing the RAM FORWARD and REVERSE flags and the MOTOR ENABLE flag as indicated in block 170. The subroutine then restarts a watchdog timer as indicated in block 172. This watchdog timer is used to monitor the operation of the system and will time out in the event it is hung up during execution of the program and will turn off the system. After the watchdog timer is restarted, the Background subroutine will inquire if the START switch is on as indicated by decision block 174. If the start switch is on, the subroutine will clear the one half second debounce timer as indicated in block 176. The subroutine will then restart the watchdog timer again as indicated by block 178, then inquire, as indicated by decision block 180, if the START switch is still on. If the START switch is still on, the subroutine will inquire if the debounce time is greater than one half second as specified in decision block 182. If the START switch is not on, the subroutine will return to the beginning of the Background subroutine. If the debounce time is not greater than one half second the system will return to restart the watchdog time, block 178, and wait until the START switch is on for a period longer than one half second before it continues. This routine is to assure that the START switch is actually turned on and that the system is not responding to a sporadic noise signal or that the START switch failed to close properly. After the debounce time exceeds one half second, the subroutine will then inquire, as indicated by decision block 184, if the MODE switch is in the AUTO position or the MAN position. If the MODE switch is in the automatic control position the program will proceed to call up the automatic control routine as indicated by termination block 186. If the MODE switch is not in the automatic position, the program will revert to the manual control as indicated by block 188.

If the START switch is not on as indicated in decision block 174, the Background subroutine will inquire, as indicated by decision blocks 190 through 196, if a self-test is to be conducted. As previously indicated, this self-test is only performed during manufacture and is not used during every day operation of the system.

When the START switch is not on, the subroutine will inquire if the RAM POSITION switch 72 (FIG. 3) is in the self-test position as specified in decision block 190. It if is, it will next inquire if the RAM FORWARD switch and RAM REVERSE switch are both on as indicated by decision blocks 192 and 194. Since the forward and reverse positions of the RAM DIRECTION switch 40 (FIG. 2) are mutually exclusive, the condition where both are on at the same time can only be simulated at the point of manufacture, and cannot be achieved by the actuation of the RAM DIRECTION switch 40.

If the RAM FORWARD and RAM REVERSE switches are both on at the same time, the subroutine finally inquires, decision block 196, if the cycle switch 61 (Figure) is set to zero. If all these conditions simultaneously exist the subroutine will call the Self-Test subroutine as indicated by termination block 198.

If the answer to any of these inquires, decision blocks 190 through 196, is no, the subroutine returns to its beginning.

Since the Self-Test subroutine is only a manufacturing tool and is not involved with the operation of the system, the details of the Self-Test subroutine are not required for an understanding of the automatic mode of operation of the compaction system and are not included herein.

Figure 8:
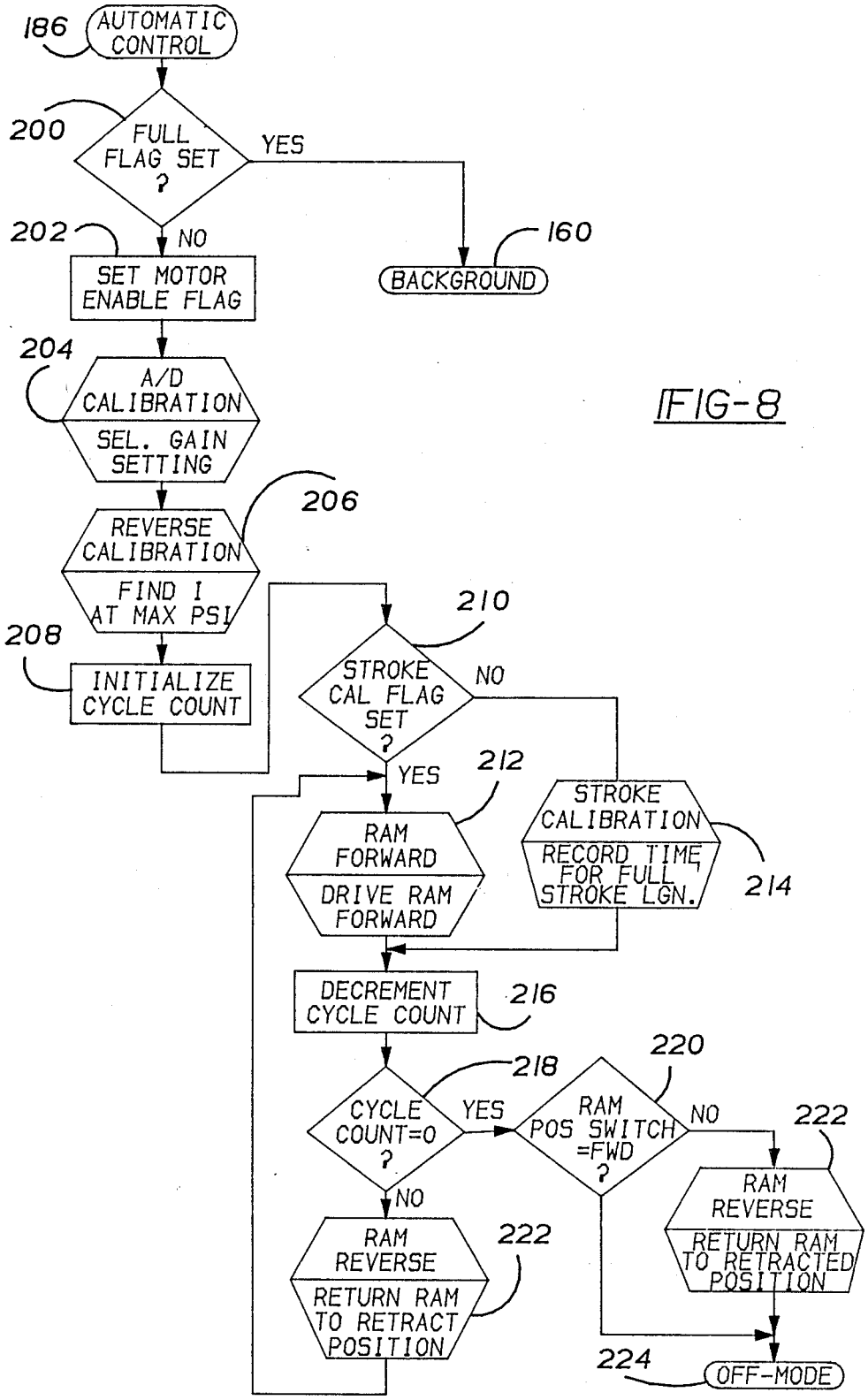
FIG. 8 is a flow diagram of the Automatic Control program.

The automatic control program 186 is shown in FIG. 8. The automatic control program begins by inquiring if the FULL flag is set as indicated by block 200. If the FULL flag is set indicating that the trash container is full, the automatic control program will terminate and the program will return to the Background subroutine 160. Otherwise, if the FULL flag is not set,the automatic control program will set the MOTOR ENABLE flag, as indicated by block 202, then proceed to call up the Analog to Digital Calibration subroutine as indicated by block 204. Upon completion of the Analog to Digital Calibration subroutine, the program will call up the Reverse Calibration subroutine as indicated by block 206. After the Reverse Calibration Subroutine is complete the automatic control program will initialize the cycle count, block 208, to the count indicated by the cycle switch 61 shown in FIG. 3. The cycle switch 61 will transmit to the computer a number corresponding to the number of times the ram is to be cycled back and forth upon each actuation of the system. After the cycle count is initialized the program will inquire if the STROKE Calibration flag is set as indicated by decision block 210. If the STROKE Calibration flag is not set the program will proceed to call up the Stroke Calibration subroutine as indicated by block 214, otherwise, the program will call up the Ram Forward subroutine as indicated by block 212. The Stroke Calibration subroutine will record the time required for the ram to be extended to its full extension while the Ram Forward subroutine will drive the ram forward for a predetermined period of time. After completing either the Stroke Calibration subroutine or the Ram Forward subroutine the automatic control program will decrement the cycle count as indicated by block 216. After the cycle count is decremented, the program will inquire, as indicated by decision block 218, if the cycle count is equal to 0. If the cycle count is not equal to 0, the program will call up the Ram Reverse subroutine as indicated by block 222. After execution of the Ram Reverse subroutine, the program will call up the Ram Forward subroutine as indicated by block 212. This cycle will be repeated until the cycle count equals 0. When the cycle count equals 0, the program will inquire, as indicated by decision block 220, if the ram position switch 72, shown in FIG. 3, is in the forward position. If the ram position switch is in the forward position, the program will call up the Off Mode subroutine as indicated by termination block 224, otherwise, the program will proceed to call up the Ram Reverse subroutine, block 222, returning the ram to its retracted position.

Figure 9:
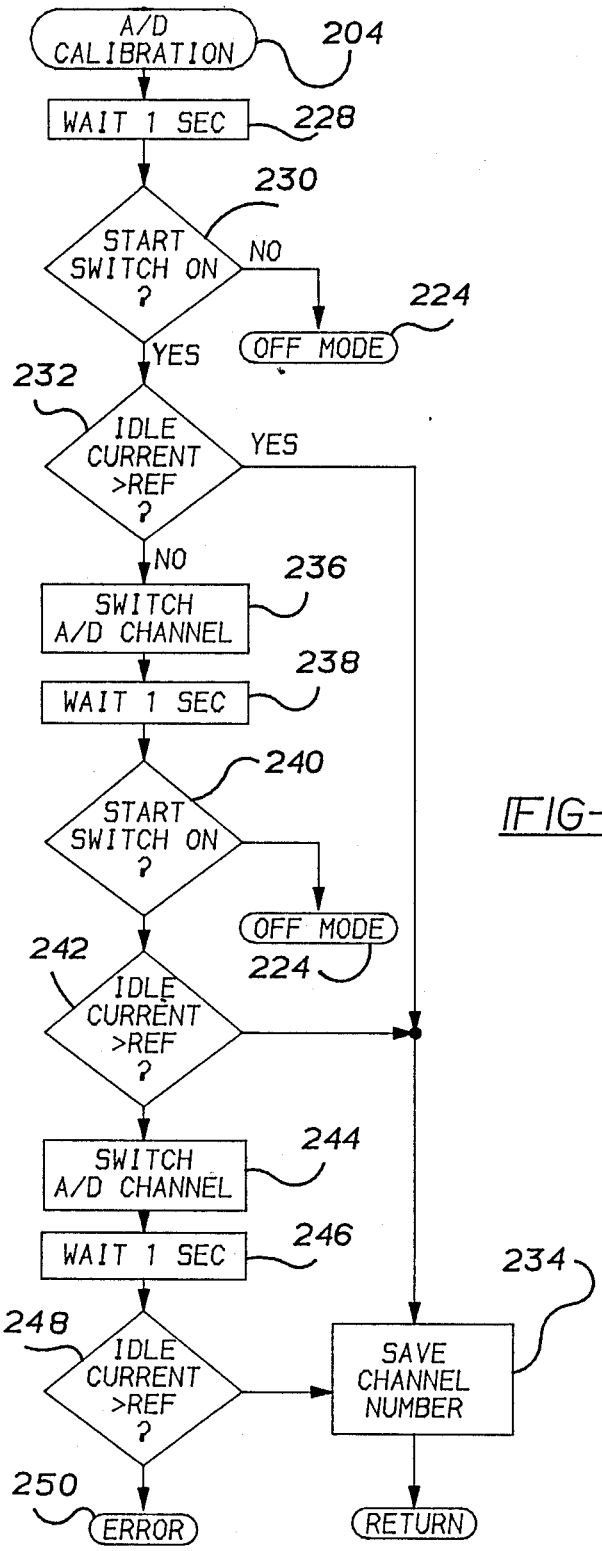
FIG. 9 is a flow diagram of the Analog to Digital (A/D) subroutine.
Figure 10:
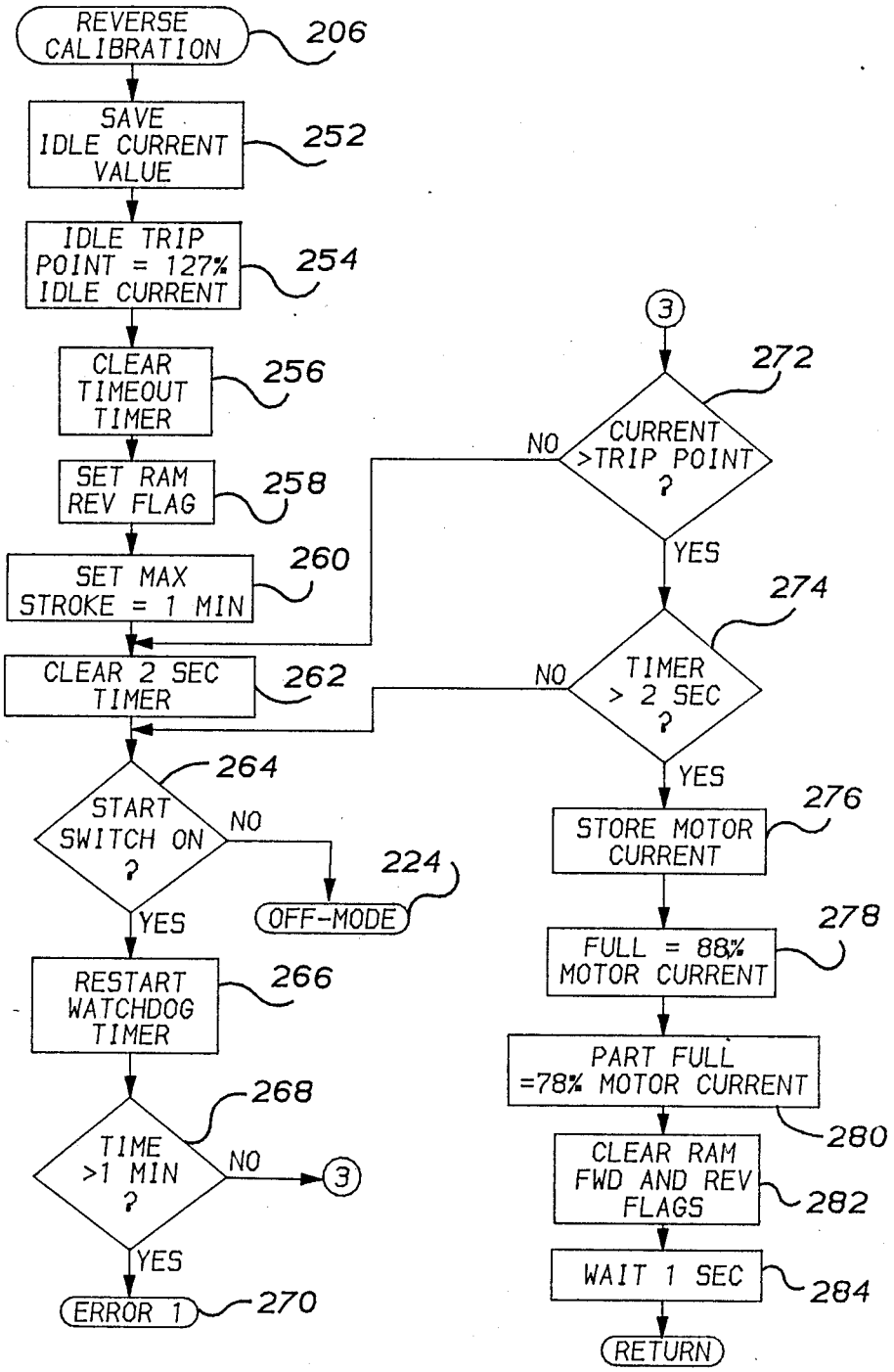
FIG. 10 is a flow diagram of the Reverse Calibration subroutine.

The details of the Analog-to-Digital (A/d) Calibration subroutine 204 are shown in FIG. 9. As previously indicated relative to FIG. 1, the output of the current sensor 34 is connected in parallel to three amplifiers 76, 78, and 80, having different gains. The outputs of these amplifiers are connected to separate analog-to-digital converter inputs A/D2, A/D3, and A/D4 of the microprocessor 50. In the calibration of the system, the microprocessor 50 will select the output of one of the three analog-to-digital converters. The Analog-to-Digital (A/D) Calibration subroutine 204 described below delineates the details of the selection process.

After waiting one second, as indicated in block 228, the microprocessor will inquire, block 230, if the start switch is on. If the start switch is on, the microprocessor will check the output of the first analog-to-digital converter to determine if its output is greater than a reference value as indicated by block 232. If the start switch is on, the microprocessor will go to the Off Mode subroutine shown in FIG. 14. If the output of the first analog-to-digital converter indicates the idle current is greater than the reference value, the computer will save the channel number of the first analog-to-digital converter, as indicated in block 234, and return to the Automatic Control program 186. The channel number saved represents the analog-to-digital converter whose output will be used to determine when the trash container is part full or full as previously indicated.

If the idle current is less than the reference value, the microprocesor 50 will switch to the next analog-to-digital channel (A/D converter), as indicated in block 236, and again wait for one second as indicated by block 238. The microprocessor will again inquire, decision block 240, if the start switch is on and, if it is, again determine, decision block 242, if the idle current is greater than the reference value. If the idle current is greater than the reference value, the new channel number is saved, as indicated in block 234, otherwise the microprocessor will switch to the third channel (A/D converter), as indicated by block 244. After waiting for one second, as indicated by block 246, the microprocessor will again inquire, decision block 248, if the idle current is greater than the reference value. The channel number of the third analog-to-digital converter will be saved, as indicated in block 234, if the idle current is greater than the reference value, otherwise an error signal will be generated, as indicated by termination block 250, indicating that the idle current outputs of all three analog-to-digital converters are unsatisfactory for determining part full and full load current values.

The saving of a channel number, as indicated by block 234, as the result of a determination that the idle current was greater than the reference value by decision blocks 232, 242, or 248, terminates the Analog-to-Digital Calibration subroutine 204 and the microprocessor 50 returns to the Automatic Control program 186 and then proceeds to execute the Reverse Calibration subroutine 206.

The Reverse Calibration subroutine 206 is to find the current being used by the motor 28 at a pressure equal to 2,000 psi. In this procedure, the ram is retracted to its retracted position and held in this position for two seconds with the solenoid 86 energized so that the pressure to the hydraulic cylinder 14 from the pump is equal to 2,000 psi. The maximum output pressure of the pump is controlled by a pressure regulator valve in the system. As is known in the art, the pressure regulator valve may be set at an alternate pressure for calibration purposes as desired. The Reverse Calibration subroutine begins by saving the idle current value of the motor 28, block 252, when the three-way solenoid valve 26 is in the neutral position in which the output of the pump is being circulated back to the fluid reservoir 48. The subroutine then calculates an idle trip point which is equal to 127% of the idle current as indicated by block 254. The routine then clears a timeout timer, as indicated by block 256, and sets the RAM REVERSE flag as indicated by block 258. The setting of the RAM REVERSE flag will automatically energize the Ram Reverse solenoid 86 of the three-way solenoid 26 during the next subsequent 60 hertz External Interrupt subroutine as shall be explained with reference to the flow diagram shown in FIG. 16. The subroutine will then set a maximum stroke timer to one minute, as indicated by block 260, then clear the two second timeout timer as indicated in block 262. The program will then inquire, as indicated in decision block 264, if the START switch is on. If the START switch is not on, the program will proceed to the Off Mode subroutine 224; otherwise, if the START switch is on, the program will restart the watchdog timer as indicated by block 266. After restarting the watchdog timer the program will inquire, decision block 268, if the stroke timer has exceeded one minute. If it has, the system will generate an error, as indicated by block 270; otherwise, the subroutine will proceed to inquire if the motor current is greater than the trip point as indicated by block 272. If the current has not exceeded the trip point, the program will return and clear the two second timer as indicated by block 262. If the current trip point is exceeded, the subroutine will inquire, as indicated by decision block 274, if the time on the two second timer is greater than two seconds. If the time is not greater than two seconds, the subroutine will return to inquire if the START switch is on as indicated by block 264. Otherwise, if the timer has exceeded two seconds indicating that the pressure from the output of the pump being applied to the hydraulic cylinder 14 is 2,000 psi, the subroutine will proceed to store the motor current as indicated by block 276. The subroutine will then calculate the predetermined FULL value to be equal to 88% of the motor current, as indicated by block 278, and the predetermined PART-FULL value equal to 78% of the motor current as indicated by block 280. The subroutine will then proceed to clear the RAM FORWARD and REVERSE flags, as indicated by block 282, and wait one second, as indicated by block 284, before returning to the automatic control program 186. As a result of clearing the RAM FORWARD and REVERSE flags, the solenoids 84 and 86 will be deenergized during the next subsequent 60 hertz Interrupt subroutine.

Figure 11:
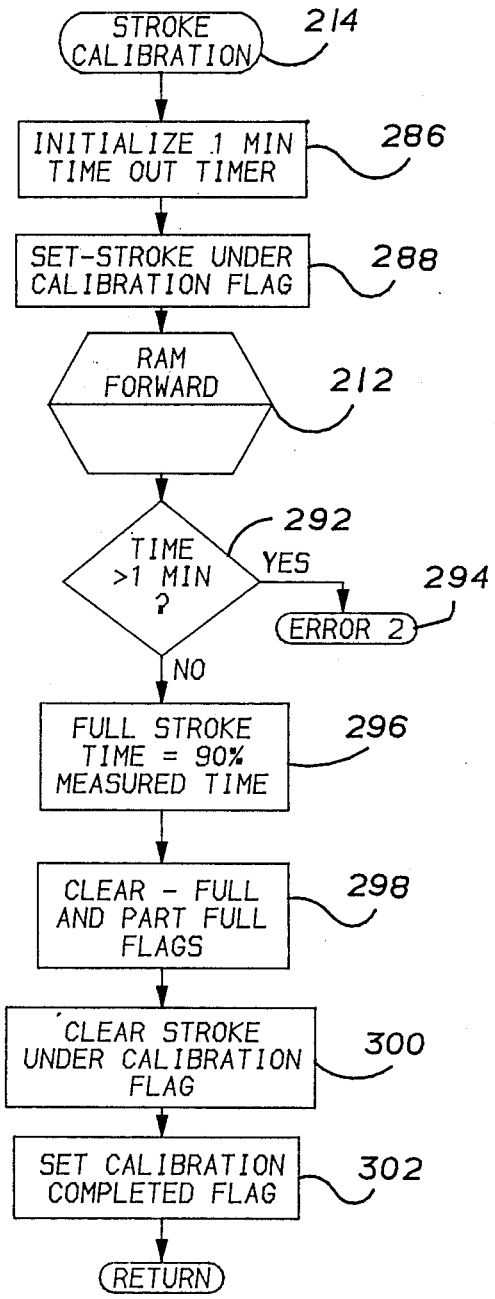
FIG. 11 is a flow diagram of the Stroke Calibration subroutine.

The Stroke Calibration subroutine 214 is shown in the flow diagram of FIG. 11. The Stroke Calibration subroutine finds the time required for the ram to move to its extreme forward position. The Stroke Calibration subroutine begins by initializing a one minute timeout timer as indicated by block 286. The subroutine will then set the STROKE under calibration flag, as indicated by block 288, and call up the Ram Forward subroutine 212 as shall be described relative to the flow diagram shown in FIG. 12. Upon completion of the Ram Forward subroutine the Stroke Calibration subroutine will inquire if the time required to complete the Ram Forward subroutine was greater than one minute as indicated by decision block 292. If the time exceeded on minute the Stroke Calibration subroutine will generate an error signal, as indicated by block 294, which will terminate the Stroke Calibration subroutine. If the time is less than one minute, the subroutine will calculate, block 296, the full stroke time to be equal to 90% of the measured time. The subroutine will then clear the FULL and PART-FULL flags, as indicated by block 298, then clear the STROKE under calibration flag as indicated by block 300. The Stroke Calibration subroutine will then set the CALIBRATION COMPLETED flag, as indicated by block 302, and return to the automatic control program 186.

The details of the Ram Forward subroutine 212 are shown in the flow diagram illustrated in FIG. 12. The function of the Ram Forward subroutine is to move the ram from the retracted position to the extended position compacting the trash in the trash container 12. The Ram Forward subroutine begins by clearing the timeout timer and the one half second timer, as indicated by block 304, and setting the RAM FORWARD flag as indicated by block 306. The subroutine will then wait two minutes for the motor to be started and the starting current to subside, as indicated by block 308, and then proceed to clear the one half second timer as indicated by block 310. The subroutine will then restart the watchdog timer, as indicated by block 312, then inquire, decision block 314, if the start switch is on. If the start switch is not on, the subroutine will switch to the Off Mode subroutine 224. If the start switch is on, the Ram Forward subroutine will inquire, decision block 316, if the motor current is greater than the PART-FULL value. If the motor current is not greater than the PART-FULL value, the subroutine will proceed to inquire, as indicated by block 324, if the motor current is greater than the FULL value.

If the motor current is greater than the PART-FULL value, the program will proceed to inquire, as indicated by block 318, if the FULL flag is set. If the FULL flag is set, the subroutine will jump to block 324 and inquire if the motor current is greater than the full current; otherwise, the subroutine will inquire, as indicated by block 320, if the one half second timer is greater than one half second. If the one half second timer is not greater than one half second, the subroutine will return and inquire if the start switch is on, as indicated by block 314, effectively waiting for the one half second timer to expire. Once the one half second timer expires the Ram Forward subroutine will set the PART-FULL flag, as indicated by block 322, then proceed to inquire if the motor current is greater than the FULL value as indicated by block 324. If the motor current is not greater than the FULL value, the subroutine will set the forward time equal to the timeout time, as indicated by block 340, then inquire if the timeout time is equal to full time as indicated by block 342. If the timeout time is equal to or greater than the full time, the subroutine will clear the RAM FORWARD flag, as indicated by block 344, and wait one second as indicated by block 346.

As previuosly indicated, clearing of the RAM FORWARD flag will subsequently result in the deenergizing of the ram forward solenoid 84 of the three-way solenoid valve 26 during the next subsequent 60 hertz Interrupt subroutine. However, if the timeout time is not greater than the full time, the subroutine will return to block 310 and clear the one half second timer then restart the watchdog timer as indicated by block 312. If the motor current is greater than the full value, the subroutine will proceed to determine, decision block 326, if the one half second timer is greater than one half second. If it is not, the program will return to decision block 314 and will repeat the intermediate steps until the one half second timer is greater than one half second. This subroutine is used to make sure that the motor current is actually greater than the fully value and that the detected increase in motor current was not a momentary occurrence resulting from the ram hanging up in the compactor. When the motor current is greater than the full value for more than one half second, the Ram Forward subroutine will clear the PART-FULL flag, as indicated by block 328, then set the FULL flag as indicated by block 330, clear the RAM FORWARD flag, as indicated by block 332, and save the stroke forward time, as indicated by block 334. The subroutine will then wait one second, as indicated by block 336, then set the cyle count to one as indicated by block 338. As previously discussed relative to the automatic control program 186, the cycle count will be decremented to 0 following the execution of the Ram Forward subroutine. Decrementing of the cycle count to 0 will then result in either the program terminating with the ram in the forward position or the ram will be returned to its retracted position and the automatic control program terminated.

Figure 13:
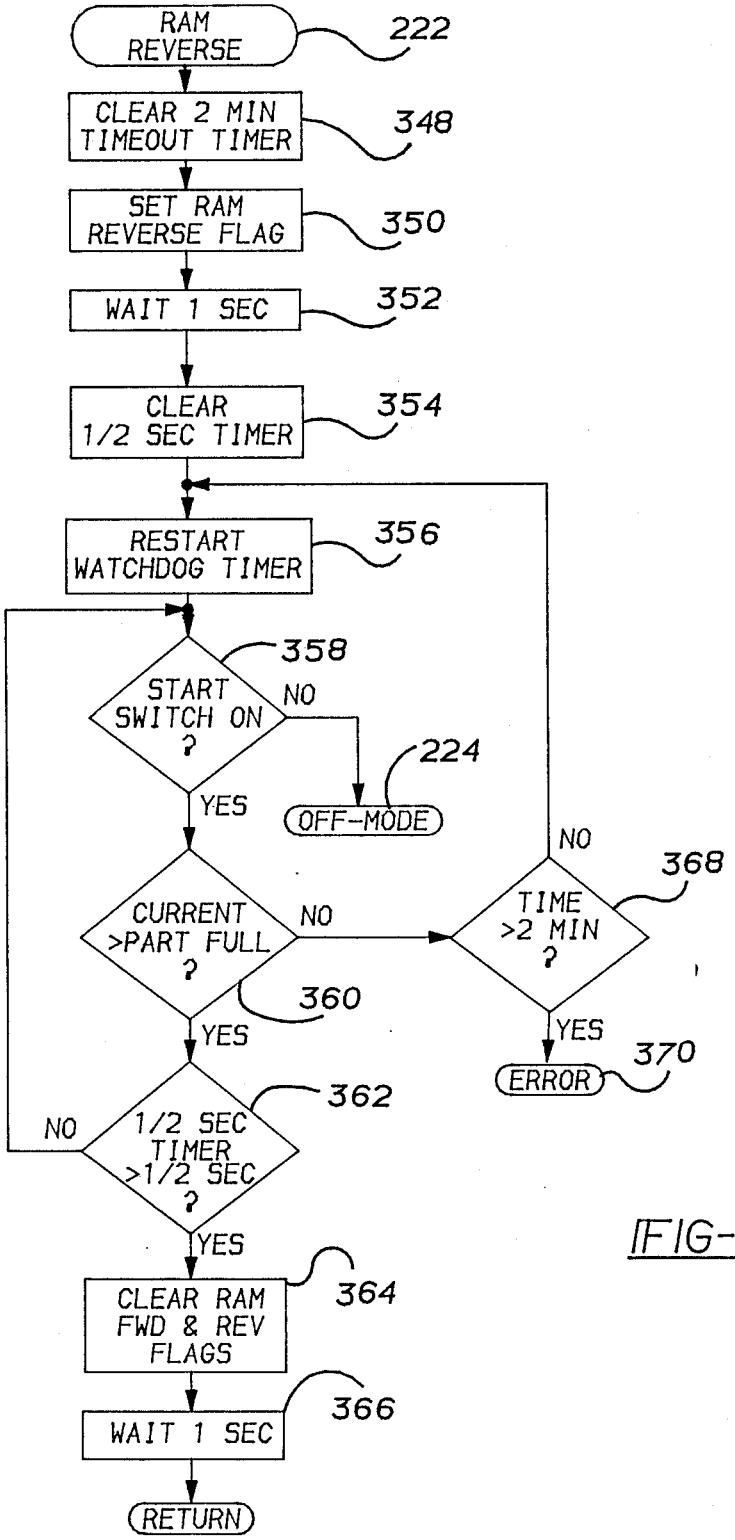
FIG. 13 is a flow diagram of the Ram Reverse subroutine.

The details of the Ram Reverse subroutine 222 are shown in the flow diagram of FIG. 13. The function of the Ram Reverse subroutine is to return the ram to its retracted position in the compactor. The Ram Reverse subroutine begins by clearing the two minute timeout timer, as indicated by block 348, then setting the RAM REVERSE flag as indicated by block 350. As previously indicated, setting of the RAM REVERSE flag will result in the actuation of the ram reverse solenoid 86 of the three-way solenoid valve 26 during the next subsequent External Interrupt subroutine. The subroutine will then wait one second for the motor current to settle out, as indicated by block 352, then clear the one half second timer as indicated by block 354. The subroutine will restart the watchdog timer, as indicated by block 356, then inquire, as indicated by block 358, if the START switch is on. If the START switch is not on, the program will proceed to the Off Mode subroutine 224; otherwise, the subroutine will inquire, as indicated by block 360, if the current is equal to or greater than PART-FULL. If the current is not equal to or greater than PART-FULL, the subroutine will inquire if the time is greater than two minutes as indicated by block 368. If the return time is greater than two minutes, it indicates that the ram has hung up in its extended forward position and the subroutine will generate an error signal, as indicated by termination block 370, terminating the Ram Reverse subroutine. However, if the motor current is greater than the PART-FULL value, the subrouting will proceed to inquire if the one half second timer has exceeded one half second as indicated by decision block 362. If the one half second timer is not greater than one half second, the program will recycle back to the restart watchdog timer, block 356, and repeat the intermediate steps until the one half second timer does exceed one half second to assure that the current is greater than the PART-FULL load. Once the one half second timer exceeds one half second the subrouting will clear the RAM FORWARD and REVERSE flags, block 364, which will result in the deenergizing of the ram reverse solenoid 86 during the External Interrupt subroutine. The Ram Reverse subroutine will than wait one second, as indicated by block 366, and return to the automatic control program 186. At the end of the Ram Reverse subroutine the ram is fully extended to approximately 90% of its maximum length.

Figure 14:
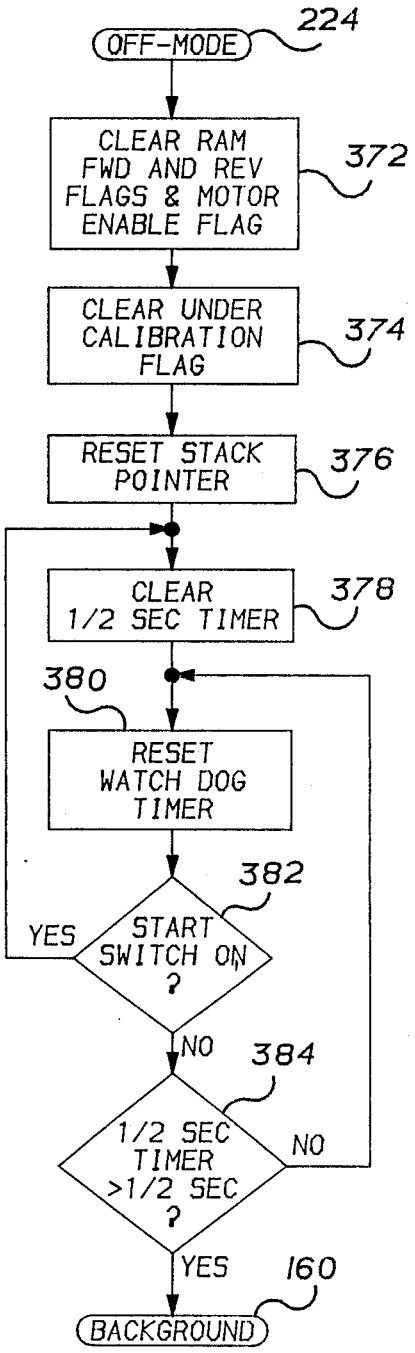
FIG. 14 is a flow diagram of the Off-Mode subroutine.

The details of the Off Mode subroutine 224 are shown in the flow diagram of FIG. 14. The function of the Off Mode subroutine is to clear all of the flags and reset the pointers. The Off Mode subroutine begins by clearing the RAM FORWARD and REVERSE flags and the MOROT ENABLE flag as indicated by block 372. The subroutine will then clear the UNDER CALIBRATION flag 374 and reset the stack pointers as indicated by block 376. The subroutine will then proceed to clear the one half second timer, as indicated by block 378, and reset the watchdog timer as indicated by block 380. The Off Mode subroutine will then inquire if the START switch is still on as indicated by block 382. If the START switch is still on, the program will return to clear the one half second timer, as indicated by block 378, and reset the watchdog timer as indicated by block 380. This procedure will be repeated until the START switch is turned off. Once the START switch is turned off, the Off Mode subroutine wil inquire if the one half second timer is greater than or equal to one half second as indicated in block 384. If it is, the program will return to the Background subroutine 160; otherwise, the subroutine will return to block 380, reset the watchdog timer and inquire once more if the START switch is on, as indicated by block 382, until the one half second timer is greater than one half second. The half second timer wait is to assure that the START switch is actually off.

Figure 15:
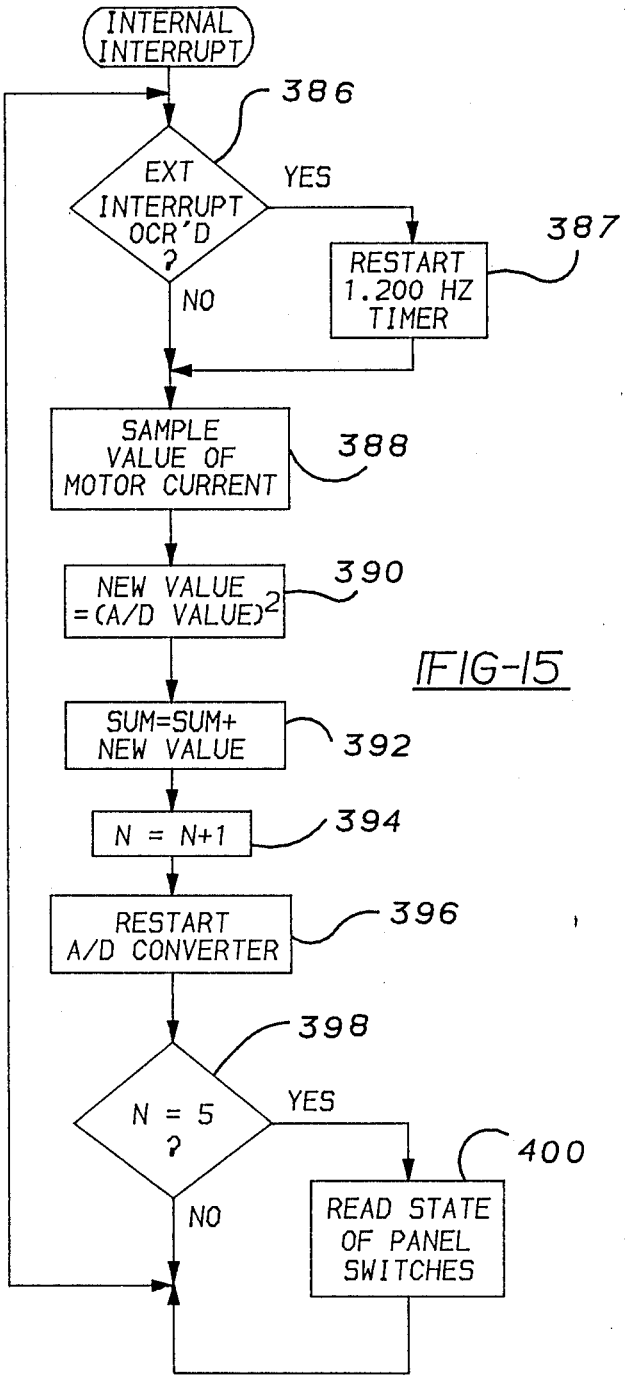
FIG. 15 is a flow diagram of the Internal Interrupt subroutine.

The details of the internal interrupt referred to previously are shown in the flow diagram illustrated in FIG. 15. The internal interrupt is synchronized with the external interrupt and the subroutine begins by inquiring, as indicated in block 386, if the external interrupt has occurred. If the external interrupt has occurred, the internal interrupt will restart the 1,200 hertz timer, as indicated by block 387; otherwise, the external interrupt will sample the value of the motor current as indicated by block 388. The new value of the motor current is then squared, as indicated by block 390, to generate a new value. The sum of the motor current is then generated by adding the new value to the previous sum of the motor current, as indicated by block 392, and the nuber of samples taken are then incremented as indicated by block 394. After the sample has been taken and the new sum generated the Analog to Digital converter is restarted as inciated by block 396. The internal interrupt will then inquire if the number of samples after the occurrence of the external interrupt is equal to five as indicated by block 398. If the number of samples is five, the internal interrupt will direct that the value of the switches on the panel and the internal switches be read as indicated by block 400. The internal interrupt will then, again, recycle and ask if the external interrupt has occurred as indicated by block 386. The interrupt will continue to take new samples and generate a new sum value for the motor current until the next external interrupt occurs.

Reading of all the switches, as indicated in block 400, occurs once during every external interrupt. Reading of the switches, as indicated by block 400, occurs after the fifth sample is taken. This synchronizes the reading of the output switches so that the A.C. current has its peak value and avoids the reading of these switches when the A.C. current is at 0 crossing. This assures that the values read are correct.

The details of the external interrupt are shwon in the flow diagram in FIG. 16. The external interrupt calculates the average (RMS) value of the new current and turns on the motor 28 when the MOTOR ENABLE flag is set and turns on the ram forward and reverse solenoids 84 and 86, respectively, when the respective RAM REVERSE or RAM FORWARD flags are set. It also will turn on the PART-FULL and FULL lamps 46 and 44, respectively, when the PART-FULL and FULL lamp flags are set. The external interrupt is generated by the 0 crossing detector circuit shown in FIG. 5. The external interrupt begins by inquiring if the value of n generated by the Internal Interrupt subroutine is equal to or greater than 18. If it is not, it will wait until the value of n is equal to 18 as indicated by decision block 402. If n is equal to or greater than 18, the external interrupt will proceed to increment the timeout timer, as indicated by block 404, and inquire if n is equal to or greater than 37 as indicated by block 406. If n is equal to or greater than 37, n will be multiplied by 2, block 408, to generate a new n, then divided by the sum of the new value of n, as indicated in block 410, to generate a new average current value. The external interrupt will then add the new current value to the old average current value and divide by 2 to generarte the current, as indicated by block 412. The external interrupt will then clear the value of n and the new current, as indicated by block 414, and proceed to inquire if the MOTOR ENABLE flag is set, as indiated by decision block 416. However, if n is not equal to 37, the external interrupt will jump to decision block 416 and inquire if the MOTOR ENABLE flag is set. If the MOTOR ENABLE flag is set, the external interrupt will turn on the motor 28 be actuating the solenoid switch 82, as indicated by block 418; otherwise, it will turn off the motor as indicated by block 420. The external interrupt will then inquire if the RAM REVERSE flag is set as indicated in block 422. If the RAM REVERSE flag is set, the external interrupt will actuate the reverse solenoid, as indicated by block 424, or turn the reverse solenoid off as indicated by block 426. The external interrupt will then inquire if the RAM FORWARD flag is set as indicated by block 428. If the RAM FORWARD flag is set, the external interrupt will proceed to turn the forward solenoid on, as indicated by block 430, or turn off the forward solenoid as indicated by block 432. The external interrupt will then inquire if the STROKE CALIBRATION flag is set as indicated by block 434. If the STROKE CALIBRATION flag is set, the external interrupt will turn off the PART-FULL lamp is indicated by block 436. However, if the STROKE CALIBRATION flag is not set, the subroutine will inquire if the PART-FULL flag is set as indicated by block 438. If the PART-FULL flag is set, the subroutine will turn on the PART-FULL lamp as indicated by block 440. Otherwise, if the PART-FULL flag is not set, the external interrupt will jump to block 436 and turn off the PART-FULL lamp. The external interrupt will, again, inquire, block 442, if the STROKE CALIBRATION flag is set. If the STROKE CALIBRATION flag is set, the external interrupt will turn off the FULL lamp as indicated by block 444. However, if the STROKE CALBRATION flag is not set, the external interrupt will inquire, block 446, if the FULL flag is set. If the FULL flag is set the external interrupt will turn on the FULL lamp as indicated by block 448; however, if the FULL flag is not set, the external interrupt will jump to block 444 and turn off the FULL lamp. The external interrupt will then return to the program and wait for the occurrence of the next external interrupt.

Figure 17:
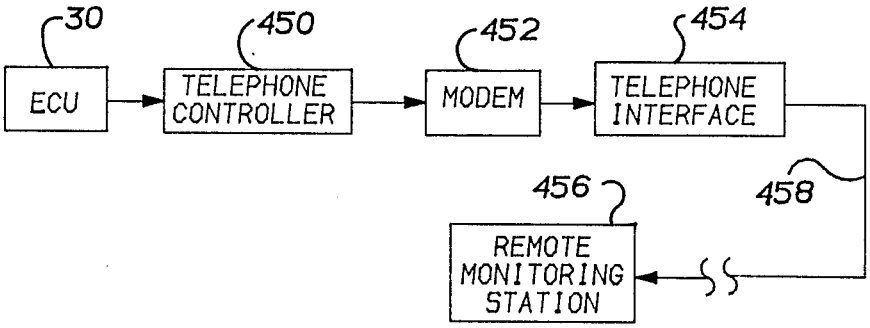
FIG. 17 is a block diagram showing a telephone communication system linking the electronic control unit with a remote monitoring station.

As with the automated trash management system taught by Neumann, U.S. Pat. No. 4,773,027, the system may include a communication subsystem having a telephone controller 450, a modem 452 and a telephone interface 454 which permits the trash compactor 10 to communicate with a remote monitoring station 456 as shown in FIG. 17 over existing telephone lines 458. The communication subsystem may transmit PART-FULL AND FULL signals generated by the electronic control unit 30 indicative of the fullness of each container so that a truck may be dispatched by the remote monitoring station 456 to each full trash container to either replace it with an empty one or to empty the full trash container.

Figure 18:
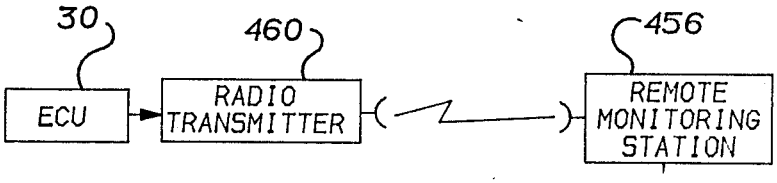
FIG. 18 is a block digram showing a radio communication system linking the electronic control unit with a remote monitoring station.

The communication subsystem may also transmit the content of all of the microprocessors' registers and the content of the memory of any error signals that may have been generated indicating that a fault has been detected in its operation. Alternatively, the telephone interface may be a radio transmitter 460 transmitting the data to the remote monitoring station 456 as shown in FIG. 18.

It is not intended that the invention be limited to the specific embodiment shown or the specific program illustrated in the drawings and discussed in the specification. It is well known that those skilled in the invention. Accordingly, improvements or changes may be made to the invention without departing from the spirit or the scope disclosed herein and set forth in the appended claims.

What is claimed is:

1. An automated trash compaction system for compacting trash in a trash compactor comprising:

compactor means connected to said trash container, said compactor means having a ram;

an hydraulic cylinder for displacing said ram in a forward direction to compact the trash in said trash container and in a reverse direction to return said ram to a retracted position;

a fluid pump for providing a pressurized fluid to said hydraulic cylinder;

a solenoid valve disposed between said fluid pump and said hydraulic cylinder, said solenoid vavle having at least at first state in response to a ram forward signal direction said pressurized fluid to a forward input of said hydraulic cylinder causing said hydralic cylinder to displace said ram in said forward direction and switchable to at least a second state in response to a ram reverse signal directing said pressurized fluid to a reverse input of said hydraulic cylinder causing said hydraulic cylinder to displace said ram in said verse direction;

and electric motor for actuating said fluid pump;

a current sensor for generating a current signal having a value corresponding to the value of the electric current being used by said electric motor;

means for generating a start signal; and an electronic control unit having means for generating said ram forward signal for a predetermined period of time in response to said start signal, means for generating a part-full signal in response to said ram forward signal and in response to said current signal exceeding a full value, means for generating said reverse signal in response to the expiration of said predetermined period of time, and means for terminating said reverse signal when said current signal exceeds a stop value.

2. The trash compaction system of claim 1 wherein said stop value is equal to said part-full value.

3. The trash compaction system of claim 1 wherein said electronic control unit further comprises:

stroke calibration means for generating said predetermined period of time; and reverse calibration means for generating said stop value.

4. The trash compaction system of claim 3 wherein said reverse calibration means further comprises:

means for generating said part-full value of said current signal; and means for generating said full value of said current signal.

5. The trash compaction system of claim 1 wherein said means for generating said ram forward signal further comprises means responsive to the generation of said full signal for terminating the generation of said ram forward signal before the expiration of said predetermined period of time.

6. The trash compaction system of claim 4 wherein said solenoid valve has a third state directing said pressurized fluid to a reservoir, said reverse calibration means comprising:

means for storing the value of said current signal as an idle current when said solenoid valve is in said third state;

means for generating an idle trip point having a value slightly greater thant said idle current;

means for detecting when said current signal exceeds said trip point;

timer means for generating a time up signal a predetermined period of time after the detection of said trip point;

means for storing said current signal as a maximum value in response to said time up signal; and means for generating said full value having a value equal to approximately 90 percent of said maximum value and said part-full value having a value equal to approximately 80 percent of said maximum value.

7. The trash compaction system of claim 6 wherein said stroke calibration means comprises:

a stroke calibration flag;

a stroke under calibration flag;

a calibration completed flag;

means responsive to said stroke calibration flag not being set for setting said stroke under calibration flag;

means responsive to the seeting of said stroke under calibration flag for actuating said means to generate said ram forward signal;

a stroke timer started in response to the generation of said ram forward signal to generate a stroke time;

means responsive to said current signal exceeding said full value for terminting the generation of said ram forward signal;

means responsive to the termination of said ram forward signal for storing said stroke time;

means for multiplying said stroke time by a value less than one to generate said predetermined time; and means responsive to the generation of said predetermined period of time for terminating said stroke under calibration flag for setting said calibration completed flag.

8. The trash compaction system of claim 1 further comprising a cycle signal generator for generating a cycle number signal indicative of the number of times said ram is to be displaced in said forward and reverse directions in response to said start signal, said electronic control unit further comprising:

means for storing said cycle number;

means for decrementing said cycle number in response to the termination of said ram forward signal;

means for generating said ram reverse signal in response to said cycle number not being equal to zero; and means for repeating the generation of said ram forward signal, said ram reverse signal, and decrementing said cycle number until said cycle number is equal to zero.

9. The trash compaction system of claim 8 wherein said electronic control unit further comprises a ram position switch having a first position generating a forward position signal and a second position generating a retracted position signal and means responsive to said forward and retracted position signals for controlling a final position of said ram in either a forward position or a retracted position.

10. The trash compaction system of claim 9 wherein said electronic control unit is a programmed microprocesser having storage and computation capabilities.

11. The trash compaction system of claim 1 wherein said electronic control unit is a programmed microprocessor having storage and computation capabilities.

12. The trash compaction system of claim 1 furhter comprising:

a mode switch having an automatic position in which said ram forward signal and said ram reverse signal are automatically generated by said electronic control unit in response to said start signal and a manual position in which the forward and reverse displacement of said ram is manually controlled by an operator; and a manually operated ram forward and reverse selector switch for generating said ram forward signal and said ram reverse signal when said mode switch is in said manual position.

13. The trash compaction system of claim 12 wherein said means for generating said start signal is a start switch, said trash compaction system further comprising a control panel on which said start switch, said mode switch and said ram forward and reverse selector switch are mounted.

14. The trash compaction system of claim 13 further comprising a part-full indicator lamp energized by said part-full signal and a full indicator lamp energized by said full signal mounted on said control panel.

15. The trash compaction system of claim 1 further comprising a control panel on which said means for generating a start signal is mounted, said control panel further having a mode position switch having an automatic position in which said ram forward and reverse signals are generated by said electronic contol unit, a manual position and a manually operated ram direction selector switch for generating said ram forward and ram reverse signals when said mode switch is in said manual position.

16. The trash compaciton system of claim 15 wherein said control panel has a part-full indicator lamp turned on by said part-full signal and a full indicator lamp turned on by said full signal.

17. The trash compaction system of claim 1 further comprising means for transmitting said part-full and full signals to a remote monitoring station.

18. The trash compaction system of claim 17 further comprising means for detecting the faulty operation of said trash compaction system to generate error signals identifying the detected faulty operation, said means for transmitting further including means for transmitting said error signals to said remote monitoring station.

19. An electronic control for a trash compaction system having a ram displaceable by an hydraulic cylinder, a pump for generating a pressurized fluid for actuating said hydraulic cylinder, a solenoid valve controlling the pressurized fluid flow to said hydraulic cylinder, said solenoid valve having a least a first state in which said pressurized fluid causes said hydraulic cylinder to displace said ram in a first direction in response to a ram forward signal and at least a second state causing said hydraulic cylinder to displace said ram in a reverse direction in response to a reverse ram signal, an electric motor for driving said pump and a start switch for generating a start signal and for applying electrical current to sasid electric motor, said electronic control comprising:

a current sensor for generating a current signal having a value corresponding to the value of the electrical current being applied to said electric motor;

means for generating said ram forward signal for a full stroke time in response to said start signal;

means for generating a part-full signal in response to said ram forward signal and said current signal exceeding a part-full value;

means for generating a full signal in response to said ram forward signal and said current signal exceeding a full value;

means for generating said ram reverse signal in response to the expiration of said full stroke time; and means for terminating said ram reverse signal in response to said current signal exceeding a predetermined value.

20. The electronic control of claim 19 wherein said predetermined value is said part-full value.

21. The electronic control of claim 19 further comprising:

stroke calibration means for determining said full stroke time; and reverse calibration means for generating said predetermined value of said current signal.

22. The electronic control of claim 21 wherein said reverse calibration means further comprises:

means for generating said part-full value fo said current signal; and means for generating said full value of said current signal.

23. The electronic control of claim 19 wherein said means for generating said ram forward signal includes means responsive to the generation of said full signal for terminating the generation of said ram forward signal before the expiration of said full stroke time.

24. The electronic control of claim 22 wherein said solenoid valve has a third state directing said pressurized fluid to a reservoir, said reverse calibration means comprising:

means for storing the value of said current signal as an idle current when said solenoid valve is in said third state;

means for generating an idle trip point having a value greater than said idle current;

means for detecting when said current signal exceeds said idle trip point;

timer means for generating a time up signal a predetermined period of time after the detection of said idle trip point;

means for storing said current signal as a maximum value signal in response to said time up signal; and means for generating said full value having a value equal to a first predetermined percentage of said maximum value signal and said part-full value having a vlue equal to a second predetermined percentage of said maximum value signal, said second predetermined percentage being less than said first predetermined percentage.

25. The electronic control of claim 24 wherein said first predetermined percentage is approximately 90% and said second predetermined percentage is approximately 80%.

26. The electronic control of claim 24 wherein said stroke calibration means comprises:

a stroke calibration flag;

a stroke under calibration flag;

a calibration completed flag;

means responsive to said stroke calibration flag not being set for setting said stroke under calibration flag;

means for generation said ram forward signal in response to said stroke under calibration flag being set;

a stroke timer started in response to the generation of said ram forward signal to generate a stroke time;

means responsive to said current signal exceeding said full value for terminating the generation of said ram forward signal;

means responsive to the termination of said ram forward signal for storing said stroke time;

means for multiplying said stroke time by a fixed percentage to generate said predetermined period of time; and means responsive to the generation of said predetermined period of time for terminating said stroke under calibration flag and for setting said calibration completed flag.

27. The electronic control of claim 26 wherein said fixed percentage is approximately 90%.

28. The electronic control of claim 19 further comprising a cycle signal generator for generating a cycle number indicative of the number of times said ram is to be displaced in said forward and said reverse directions in response to said start signal, said electronic control further comprising:

means for storing said cycle number;

means for decrementing said cycle number in response to the termination of said ram forward signal;

means for generating said ram reverse signal in response to said cycle number not being equal to zero; and means for repeating the generation of said ram forward signal, said ram reverse signal, and decrementing said cycle number until said cycle number is equal to zero.

29. The electronic control of claim 28 further comprising a ram position switch having a forward position and a reverse position, said ram position switch generating a ram position signal corresponding to the position of said ram position switch and means responsive to said ram position signal for controlling a final position of said ram in either a forward position or a retracted position.

30. The electronic control of claim 19 wherein said means for generating said ram forward signal, means for generating said part-full and full signals, means for generating said ram reverse signal, and means for terminating said ram reverse signal is a programmed microprocessor having storage and computation capabilities.

31. The electronic control of claim 29 wherein said means for generating said ram forward signal, means for generating said part-full and full signals, means for generating said ram reverse signal, means for terminating said ram reverse signal, stroke calibration means and said reverse calibration means are a programmed microporcessor having storage and computational capabilities.

32. The electronic control of claim 19 further comprising:

a mode switch having an automatic position in which said ram forward signal and said ram reverse signal are automatically generated by said electronic control in response to said start signal and a manual position in which the displacement of said ram is manually controlled by an operator; and a manually operated ram forward and reverse selector switch for generating said ram forward signal and said ram reverse signal when said mode switch is in said manual position.

33. The electronic control of claim 32 further comprising:

a control panel on which said start switch, mode switch and ram forward and reverse selector switches are mounted;

a part-full indicator lamp mounted on said control panel energized by said part-full signal; and a full indicator lamp mounted on said control panel energized by said full signal.

34. The electronic control of claim 33 further comprising means for transmitting said part-full and full signals to a remote monitoring station.

35. A method for controlling the operation of a trash compaction system having a trash container, a ram displaceable by an hydraulic cylinder for compacting said trash in said trash container, a pump for generating a pressurized fluid, a solenoid valve for controlling the application of said pressurized fluid to said hydralic cylinder, said solenoid valve having a first state in response to a ram forward signal causing said hydraulic cylinder to displace said ram in a forward direction compacting said trash in said trash container and a second state in response to a ram reverse signal causing said ram to move in a direction opposite said forward direction, an electric motor for actuating said pump, and a start switch for generating a start signal, said method comprising the steps of:

sensing the electrical current being applied to said electric motor to generate a current signal;

generating said ram forward signal for a full stroke time in response to said start signal;

generating a part-full signal in response to said ram forward signal and said current signal exceeding a part-full value;

generating a full signal in response to said ram forward signal and said current signal exceeding a full value;

generating a ram reverse signal in response to the termination of said ram forward signal; and terminating said ram reverse signal when said current signal exceeds a stop value.

36. The method of claim 35 further comprising the steps of generating said full stroke time, and generating said stop value of said current signal, prior to said step of generating said ram forward signal.

37. The method of claim 36 further comprising the steps of generating said part-full value of said current signal and generating said full value of said current signal prior to said step of generating said ram forward signal.

38. The method of claim 37 wherein said step of generating said ram forward signal includes the step of terminating said ram forward signal in response to the generation of said full signal prior to the expiration of said full stroke time.

39. The method of claim 37 wherein said solenoid valve has a third state directing said pressurized fluid to a reservoir, said step of generating said stop value further comprising the steps of:

storing the value of said current signal as an idle current when said solenoid valve is in said third state;

generating an idle trip point having a value slightly greater than said idle current;

detecting when said current signal exceeds said idle trip point;

generating a time up signal a predetermined period of time after the detection of said idle trip point;

storing said current signal as a maximum value signal in response to said time up signal; and generating said full value having a value equal to a first predetermined percentage of said maximum value signal and said part-full value having a value equal to a seocnd predetermined percentage of said maximum value signal less than said first predetermined percentage.

40. The method of claim 39 wherein said first predetermined percentage is approximately 90% and said second predetermined percentage is approximately 80%.

41. The method of claim 36 wherein said step of generating said full stroke time comprises the steps of:

setting a stroke under calibration flag in response to a stroke calibration flag not being set;

generating said ram forward signal in response to said stroke under calibration flag being set;

starting a stroke timer in response to the generation of said ram forward signal to generate a stroke time;

terminating the generation of said ram forward signal in response to said current signal exceeding said full value;

storing said stroke time in response to the termination of said ram forward signal;

multiplying said stroke time by a fixed percentage to generate said full stroke time;

terminating said stroke under calibration flag in response to the generation of said full stroke time; and setting a calibration completed flag in response to the termination of said stroke under calibration flag.

42. The method of claim 41 wherein said fixed percentage is approximately 90%.

43. The method of claim 35 wherein said trask compaction system has a cycle switch for generating a cycle number indicative of the number of times said steps of generating said ram forward and ram reverse signals are to be generated in response to each start signal, said method further comprising the steps of:

storing said cycle number;

decrementing said cycle number in response to the termination of said ram forward signal;

generating said ram reverse signal in response to said cycle number not being equal to zero; and repeating the generation of said ram forward signal and said ram reverse signal decrementing said cycle number until said cycle number is equal to zero.

44. The method of claim 43 wherein said trash compaction system further comprises the steps of generating a ram position signal with a ram position switch, said ram position signal corresponding to a desired final position of said ram and controlling said final position of said ram in either a forward position or a retracted position in response to said ram position signal.

45. The method of claim 35 wherein said trash compaction system has a mode selection switch having an automtic position generating an automatic mode signal and a manual postion terminating said automatic mode signal, and wherein said method automatically executes said steps of generating said ram forward signal, said part-full signal, said full signal, said ram reverse signal and said step of terminating said ram reverse signal in response to said automatic mode signal.

46. The method of claim 45 wherein said trash compaction system has a ram forward and reverse selector switch for manually generating said ram forward and reverse signals, said method further comprises the steps of generating said ram forward and ram reverse signals when said mode switch is in said manual position by actuating said ram forward and reverse switch to a ram forward position and a ram reverse position, respectively.

47. The method of claim 35 further comprising the step of transmitting said part-full and full signals to a remote monitoring station.

48. The method of claim 38 further comprising the steps of:

detecting the faulty execution of said steps by said trash compaction system to generate error signals identifying the fault detected; and transmitting said error signal to a remote monitoring station.

* * * * *

UNITED STATES PATENT AND TRADEMARK OFFICE

CERTIFICATE OF CORRECTION

PATENT NO. : 4,953,109

DATED : August 28, 1990

INVENTOR(S) : Stephen A. Burgis

It is certified that error appears in the above-identified patent and that said Letters Patent is hereby corrected as shown below:

Column 1, line 60, delete "hydrualic" and insert ---- hydraulic ----.

Column 2, line 12, delete "vaule" and insert ---- value ----.

Column 3, line 43, delete "electrical" and insert ---- electronic ----.

Column 4, line 32, delete "a" (second occurrence) and insert ---- as ----.

Column 4, line 45, delete "outut" and insert ---- output ----.

Column 6, line 17, delete "initialized".

Column 6, line 18, before "as" insert ---- are initialized ----.

Column 7, line 37, after "(Figure" insert ---- 3 ----.

Column 8, line 61, delete "microprocesor" and insert ---- microprocessor ----.

Column 10, line 30, delete "on" and insert ---- one ----.

Column 11, line 21, delete "previuosly" and insert ---- previously ----.

UNITED STATES PATENT AND TRADEMARK OFFICE

CERTIFICATE OF CORRECTION

PATENT NO. : 4,953,109

DATED : August 28, 1990

INVENTOR(S) : Stephen A. Burgis

It is certified that error appears in the above-identified patent and that said Letters Patent is hereby corrected as shown below:

Column 11, line 36, delete "fully" and insert ---- full ----.

Column 12, line 17, delete "subrouting" and insert ---- subroutine ----.

Column 12, line 26, delete "outing" and insert ---- outine ----.

Column 12, line 40, delete "MOROT" and insert ---- MOTOR ----.

Column 12, line 53, delete "wil" and insert ---- will ----.

Column 13, line 8, delete "nuber" and insert ---- number ----.

Column 13, line 12, delete "inciated" and insert ---- indicated ----.

Column 13, line 32, delete "shwon" and insert ---- shown ----.

Column 13, line 65, delete "be" and insert ---- by ----.

Column 14, line 13, delete "is" and insert ---- as ----.

Column 14, line 42, delete "AND" and insert ---- and ----.

Column 14, line 59, before "inven" insert ---- art may make certain changes and/or improvements within the scope of the ----.

Column 15, line 8, delete "vavle" and insert ---- valve ----.

UNITED STATES PATENT AND TRADEMARK OFFICE

CERTIFICATE OF CORRECTION

PATENT NO. : 4,953,109

DATED : August 28, 1990

INVENTOR(S) : Stephen A. Burgis

It is certified that error appears in the above-identified patent and that said Letters Patent is hereby corrected as shown below:

Column 15, line 9, delete "at" (second occurrence) and insert ---- a ----.

Column 15, line 10, delete "direction" and insert ---- directing ----.

Column 15, line 12, delete "hydralic" and insert ---- hydraulic ----.

Column 15, line 17, delete "verse" and insert ---- reverse ----.

Column 15, line 18, delete "and" and insert ---- an ----.

Column 15, line 28, delete "full" and insert ---- part-full ----.

Column 15, line 29, after "generating" insert ---- a full signal in response to said ram forward signal and in response to said current signal exceeding a full value, means for generating ----.

Column 15, line 61, delete "thant" and insert ---- than ----.

Column 16, line 14, delete "seeting" and insert ---- setting ----.

Column 16, line 20, delete "terminting" and insert ---- terminating ----.

UNITED STATES PATENT AND TRADEMARK OFFICE

CERTIFICATE OF CORRECTION

PATENT NO. : 4,953,109

DATED : August 28, 1990

INVENTOR(S) : Stephen A. Burgis

It is certified that error appears in the above-identified patent and that said Letters Patent is hereby corrected as shown below:

Column 16, line 58, delete "esser" and insert ---- essor ----.

Column 16, line 62, delete "furhter" and insert ---- further ----.

Column 17, line 22, delete "contol" and insert ---- control ----.

Column 17, line 27, delete "compaciton" and insert ---- compaction ----.

Column 17, line 46, delete "a" (first occurrence) and insert ---- at ----.

Column 17, line 54, delete "sasid" and insert ---- said ----.

Column 18, line 14, delete "fo" and insert ---- of ----.

Column 18, line 43, delete "vlue" and insert ---- value ----.

Column 18, line 59, delete "generation" and insert ---- generating ----.

Column 19, line 48, delete "croporcessor" and insert ---- croprocessor ----.

Column 20, line 11, delete "hydralic" and insert ---- hydraulic ----.

UNITED STATES PATENT AND TRADEMARK OFFICE

CERTIFICATE OF CORRECTION

PATENT NO. : 4,953,109

DATED : August 28, 1990

INVENTOR(S) : Stephen A. Burgis

It is certified that error appears in the above-identified patent and that said Letters Patent is hereby corrected as shown below:

Column 20, line 68, delete "seocnd" and insert ---- second ----.

Column 21, line 30, delete "trask" and insert ---- trash ----.

Column 22, line 14, delete "automtic" and insert ---- automatic ----.

Column 21, line 15, delete "postion" and insert ---- position ----.

In the Abstract

Line 7, delete "supplied" and insert ---- applied ----.

Line 10, delete "supplied" and insert ---- applied ----.

Signed and Sealed this

Fifth Day of May, 1992

*Attest:*

DOUGLAS B. COMER

*Attesting Officer*

*Acting Commissioner of Patents and Trademarks*